US006434944B2

(12) United States Patent
White

(10) Patent No.: US 6,434,944 B2
(45) **Date of Patent: *Aug. 20, 2002**

(54) HIGH EFFICIENCY TURBINE

(75) Inventor: William P. White, Mountlake Terrace, WA (US)

(73) Assignee: Thermaldyne, LLC, Mountlake Terrace, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/775,707

(22) Filed: Feb. 1, 2001

Related U.S. Application Data

(63) Continuation-in-part of application No. 09/353,933, filed on Jul. 15, 1999, now Pat. No. 6,233,942.

(51) Int. Cl.[7] ..... F01K 1/00
(52) U.S. Cl. ..... 60/670; 415/202; 415/174.2
(58) Field of Search ..... 60/670; 415/202, 415/92, 170.1, 174.2

(56) References Cited

U.S. PATENT DOCUMENTS

| | | | | |
|---|---|---|---|---|
| 509,644 | A | 11/1893 | Bardsley | |
| 1,137,704 | A | 4/1915 | Dake | |
| 1,179,078 | A | 4/1916 | Dake | |
| 2,378,740 | A | 6/1945 | Viera | |
| 3,879,949 | A | 4/1975 | Hays et al. | |
| 4,087,261 | A | 5/1978 | Hays | |
| 4,339,923 | A | 7/1982 | Hays et al. | |
| 4,391,102 | A | 7/1983 | Studhalter et al. | |
| 4,511,309 | A | 4/1985 | Maddox | |
| 5,277,542 | A | 1/1994 | Nakanishi | |
| 5,313,797 | A | 5/1994 | Bidwell | |
| 5,385,446 | A | 1/1995 | Hays | |
| 6,233,942 | B1 * | 5/2001 | White | 60/670 |

* cited by examiner

*Primary Examiner*—Hoang Nguyen
(74) *Attorney, Agent, or Firm*—Holme Roberts & Owen LLP

(57) ABSTRACT

A turbine system has a turbine that uses an aeromatic hydrocarbon as a working fluid. The turbine discharges the fluid in vapor form against a boundary layer on the inside of a rotor where it condenses as it loses its energy. The outside of the rotor is formed to define chambers which are divided into suction and discharge or pressure cavities by stationary and rotating seals. Apertures connect the boundary layer to the pump chambers and apertures are positioned as discharge ports so that as the rotor rotates, it also pumps the working fluid into a closed loop system in which it is reheated and reintroduced into the turbine through a nozzle. The fluid is heated by a fluid heater that may be positioned in the interior of the rotor.

45 Claims, 12 Drawing Sheets

HIGH EFFICIENCY TURBINE

This application is a continuation-in-part of application Ser. No. 09/353,933 filed Jul. 15, 1999 now U.S. Pat. No. 6,233,942.

BACKGROUND OF THE INVENTION

1. Field

This invention relates to turbines that are powered by a working fluid supplied under pressure through a nozzle.

2. State of the Art

Closed-loop vapor powered turbine systems are well known. While different working fluids may be used in such systems, water or steam has been a typical working fluid and is in wide spread use today as the working fluid in, for example, many naval propulsion systems. Typically, steam is generated in a steam generator such as a boiler or similar device. The steam is supplied under pressure to the turbine and is passed through a nozzle which is directed at turbine blades to cause the turbine to rotate. In turn the turbine extracts energy from the steam and converts it into mechanical energy or rotational torque. As the working fluid (e.g., steam) leaves the turbine, it is typically a low energy steam which cannot easily be recycled. So the steam is condensed in a condenser into a condensate which is a liquid such as water. The condensate is then pumped back to the steam generator where heat is added to cause the condensate to vaporize (add latent heat of vaporization) into a vapor (e.g., steam). The steam is then supplied to the turbine to repeat the cycle. Thus steam systems are sometimes referred to as a closed-loop system and sometime as a closed-loop vapor-liquid system because the steam is supplied as a vapor and then converted back to a liquid all within a closed system. Of course in some cases, the steam is heated further to become superheated steam so that more energy is available to operate the turbine.

The condenser typically has another fluid which passes through to remove the latent heat of condensation and in effect transfer the latent heat of condensation to ambient. Thus, a significant amount of heat energy is lost because it is transferred out of the closed loop system. U.S. Pat. No. 1,137,704 (Drake), U.S. Pat. No. 2,378,740 (Viera) are examples of turbines that were devised for use in closed-loop steam systems. Closed loop systems are in common use today in a wide variety of commercial applications to generate electricity for commercial use by power utilities using steam driven turbines where the steam is created using a fossil fuel or nuclear power.

Closed loop systems are of relatively low efficiency because a notable amount of the energy to heat the fluid to create the steam or similar vapor is not used but rather wasted as it is extracted and removed to ambient by the condenser.

Some turbines or cylindrical devices may also be caused to rotate by directing a fluid such as a liquid under pressure against a rotatable drum-like device. See U.S. Pat. No. 509,644 (Bardsley); U.S. Pat. No. 4,390,102 (Studhalter, et al.). The energy available from liquids under pressure is relatively low.

Systems too that seek to extract energy from both a vapor and a liquid are known. See U.S. Pat. No. 5,385,446 (Hays). However Hays teaches one to use a different structure to extract the energy from the liquid and the vapor. That is, the working fluid of Hays appears to have a portion that is in the vapor stage and a portion that is in the liquid stage.

No system as been identified to applicant in which a working fluid is directed at a rotor to extract all energy in whatever form, be it vapor, liquid or a combination of vapor and liquid and to eliminate a condenser and pump the working fluid directly back into a vapor generator. That is, no system has been identified that employs a fluid drag principal for a working fluid that is a vapor or a combination of liquid and vapor.

SUMMARY OF THE INVENTION

A turbine system has turbine with a source of working fluid injected through a nozzle to urge a rotor to rotate in housing. The housing has a housing interior surface and a housing exterior surface with a first aperture formed to extend between the housing interior surface and the housing exterior surface. The first aperture is sized to communicate working fluid in liquid form from the housing interior surface to the housing exterior surface.

A rotor is mounted to rotate within the housing. The rotor has a rotor interior surface and a rotor exterior surface with a second aperture formed to extend between the rotor interior surface and the rotor exterior surface. The second aperture is sized to communicate working fluid in liquid form from the interior surface to the exterior surface.

The nozzle means is connected to receive the working fluid from the source of working fluid and is positioned to direct the working fluid relative to the rotor to urge the rotor to rotate relative to the housing. The turbine also has pump means positioned or formed between the housing interior surface and the rotor exterior surface for pumping the working fluid through the first aperture to exterior the housing.

In a preferred arrangement, the pump means includes seal means positioned between the housing interior surface and the rotor exterior surface to effect a seal there between to inhibit the passage of working fluid there past. The pump means desirably includes at least one chamber formed by the seal means, by a portion of the exterior surface of the rotor and by a portion of said interior surface of the housing. Rotation of the rotor positively pumps the working fluid received from the second aperture through the first aperture to exterior the housing.

Desirably, the turbine system has a discharge with an inlet connected to the first aperture to receive the working fluid therefrom and a outlet connected to the source of working fluid to supply the working fluid thereto. Preferably the source of working fluid includes heat means for heating the working fluid to a desired temperature and preferably the vapor temperature of the working fluid.

In a preferred arrangement, the turbine has flow control means interconnected in the discharge to control the flow of working fluid from the heat means to a vapor generator.

In a more preferred or alternate arrangement, the turbine system has throttle means interconnected in the discharge to regulate the flow through use or operator means for operation by an operator to supply signals reflective of a desired flow.

The turbine system may also desirably have a cooling circuit connected to receive a portion of the working fluid from the discharge. The cooling circuit is operable to cool a portion of the working fluid to a desired temperature a preselected amount below the temperature at which vaporization would occur at the pressure inside of the rotor. The cooling circuit includes a cool liquid supply connected to inject the working fluid cooled in the cooling circuit into the rotor.

The turbine system may also have and preferably does have deaerating means connected to communicate with the rotor interior to remove gases from the rotor interior.

The turbine system is preferably configured to extract mechanical energy from the working fluid by causing the working fluid to be directed at a fluid layer on the interior of the drum when it is rotating. The drag on the boundary layers is sufficient to transfer the energy from the working fluid to the rotor itself. As the working fluid is injected, it cools and the boundary layer increases. The second aperture and preferably a third aperture formed in the rotor are sized to communicate the working fluid in liquid form at the operating pressure in the interior of the rotor from the rotor interior to outside the rotor.

To urge the working fluid into the discharge a pump is provided. Preferably the pump here is the rotor itself which is shaped to function as a pump when combined with selected seals. The rotor exterior surface is formed with a first and second arcuate section each having a first effective radius which extends between the rotor axis and the rotor exterior surface. The rotor exterior surface also has third and fourth arcuate sections formed to have a second effective radius larger than the first effective radius. The third and fourth arcuate sections are interspaced between and unitarily formed with the first and second arcuate sections so that a section with a first effective radius alternates with a section having a second effective radius. The pump therefor has a first chamber formed by seal means, the interior surface of the housing and the third arcuate section and a second chamber formed by the seal means, the interior surface of the housing and the fourth arcuate section. The second aperture is positioned along the perimeter of the rotor to be in communication with the first chamber; and the third aperture is positioned along the rotor perimeter to be in communication with the second chamber. The seal means preferably includes a first seal positioned between the first arcuate section and the housing interior surface and a second seal positioned between the second arcuate section and the housing interior surface.

In a more preferred arrangement, the rotor is formed with arcuate sections to define a third chamber of the pump. Preferably, a plurality of stationary seals are each spaced from the other and mounted to the housing interior surface to extend away therefrom to contact said rotor exterior surface to divide each chamber of said pump into an inlet portion and an outlet portion as the rotor rotates.

Most preferably the rotor interior surface is cylindrical in shape and defines a rotor interior, and wherein said source of working fluid is positioned within said rotor.

In preferred arrangements, the source of working fluid is sized and configured to supply the working fluid at a selected temperature and pressure and flow rate to create a working fluid layer along the rotor interior surface at a desired vapor pressure of working fluid in the interior of the rotor.

In some desired configurations, the throttle means includes a regulator connected to the discharge to receive the working fluid. The regulator is operable between a first position in which no working fluid passes therethrough and a second position in which working fluid passes therethrough. The regulator having operation means such as a handle for operation by a user to operate the regulator between the first position and the second position. Most preferably the regulator is a valve.

The source of working fluid preferably includes a supply line interconnected between the heat means and the vapor generator to communicate the working fluid from the heat means to the vapor generator. The source of working fluid also desirably includes a flow control module connected in the supply line to receive working fluid from the heat means and to supply working fluid to the vapor generator. The flow control module operates to regulate the flow rate of working fluid. More preferably, the flow control module includes a sensing line connected to the discharge to receive working fluid from the discharge. The flow control module has a flow control valve connected to the sensing line to receive the working fluid therefrom and connected to said supply line to regulate the flow of working fluid therethrough. The flow control valve is operable between a closed position inhibiting the flow of the working fluid through the supply line and an open position in which the working fluid passes through the supply line to the vapor generator. The flow control module also desirable includes a pilot valve connected to the supply line to sense the pressure of the working fluid in the supply line and to send signals to said flow control valve reflective thereof. In highly preferred arrangements, the sensing line has damper means interconnected operable to dampen pressure variations in the sensing line.

In desired arrangements, the turbine system has bearings positioned to support said rotor. The working fluid is selected to be of the class that in liquid form may function as a lubricant. Thus bearing fluid means is desirably connected to the injection line in the cooling loop to receive working fluid in liquid form and to the rotor bearings to supply the working fluid as a lubricant.

In alternate arrangements the heat means includes a casing and a plurality of gas plates and a plurality of fluid plates in alternating arrangement positioned within the casing. Each of the fluid plates and each of the gas plates has a central aperture formed therein to together define a combustion chamber. Fuel source means is positioned to supply fuel to the combustion chamber. Air source means are positioned to supply air to the combustion chamber. The heat means also includes ignition means for igniting the fuel in the combustion chamber and exhaust means connected to exhaust combustion by products from the combustion chamber.

Each of said fluid plates preferably has a channel formed thereon with an inlet connected to receive the working fluid and with an outlet in communication with the vapor generator. Each of the gas plates has a plurality of heat transfer nodules positioned thereon.

Preferably, the exhaust means includes an exhaust heat exchanger connected to preheat air being supplied to the combustion chamber. More preferably the heat means includes a first catalytic converter positioned in said combustion chamber to define a first combustion zone to enhance the combustion of the fuel. The heat means may also include a second catalytic converter positioned in the combustion chamber and spaced from the first catalytic converter to define a second combustion zone between said first catalytic converter and said second catalytic converter. The second catalytic converter also functions to enhance the combustion process.

In preferred arrangements, the working fluid is an aromatic hydrocarbon and more preferably diethel benzine.

DESCRIPTION OF ILLUSTRATED EMBODIMENTS

Figure 1:
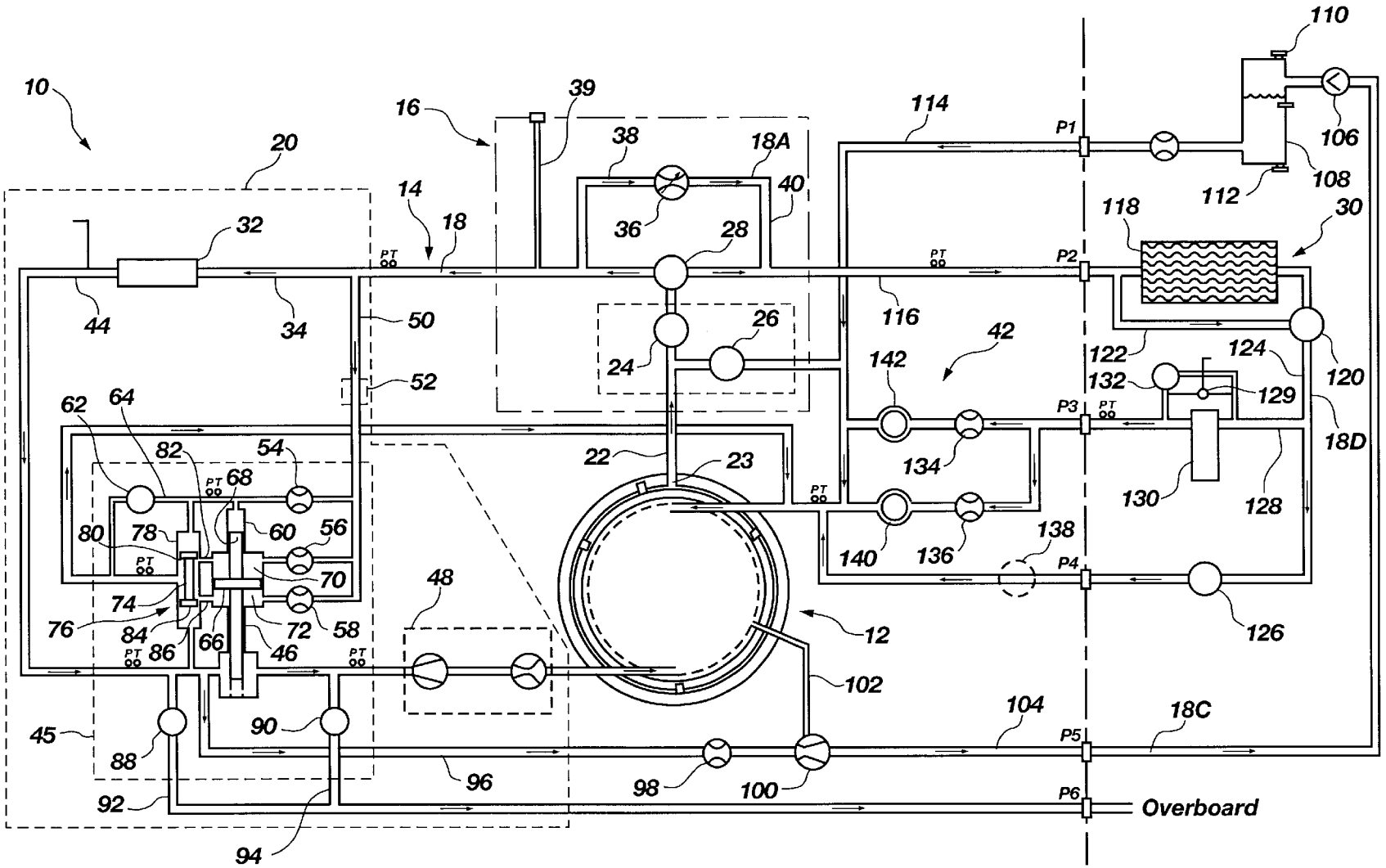
FIG. 1 is a schematic diagram of a turbine system of the present invention.

The turbine system 10 shown in FIG. 1 includes a turbine 12 connected to a discharge 14 and a throttle system 16. The discharge 14 supplies a working fluid 18 to a source of working fluid 20 which heats the working fluid 18 and returns it to the turbine 12. Thus the turbine system 10 is a closed loop system because the working fluid discharged by the turbine 12 is processed and returned to it. Except for leakage and other normal losses the amount of working fluid in the system remains essentially constant. Of course given the expansion and contraction of the fluid 18 for different power levels, a system to deal with expansion and contraction of the fluid volume is included and is discussed more fully hereinafter.

In FIG. 1, the discharge 14 includes a line 22 that is connected to the turbine 12 at its outlet 23 to receive working fluid 18 being discharged by an operating turbine 12. The line 22 may be any suitable pipe or conduit sized to transmit the volume of working fluid for the desired power levels of operation and also withstand the temperature and pressure selected for the turbine system 10 with appropriate safety margins selected by the user.

The line 22 is shown in FIG. 1 supplying the working fluid 18 to an engine brake valve 24 that is optional. The engine brake valve 24 is any suitable valve that is manually operable by a handle or electrically operable such as a solenoid valve. The engine brake valve 24 is operable between a full open (no braking) and a closed position (maximum braking). In the full open position, the flow of working fluid is unimpeded so that the turbine system is fully operable. In the fully closed position, the flow of working fluid is stopped so that the source of working fluid is no longer able to process and supply working fluid 18. In turn the turbine 12 begins to slow with the build up of fluid 18 therein. At intermediate positions some limited braking may be induced depending on the system selected.

A safety valve or relief valve 26 is also shown connected to the discharge line 22 and is set to operate to relieve an over pressure condition and thereby preserve the integrity of the turbine system. An over pressure condition could arise upon malfunction of the source of working fluid 20.

The discharge line 22 is next connected to a flow divider 28 which receives the incoming working fluid 18 and divides it with some flowing into a cooling system 30 which is discussed hereinafter. The majority of the incoming working fluid 18 is directed toward the fluid heater 32 via line 34. The flow divider 28 may be a valve-like device that is operable to divide the flow from about 50—50 to about 90–10. The flow divider 28 may also be fixed orifices or restrictors selected to divide the flow as desired for operating flow rates at given pressures and temperatures. Of course any device may be selected as desired to effect a flow division which is preferred to be from about 70–30 to about 80–20 with the smaller flow being directed toward the cooling system.

The throttle system 16 is here shown to include a throttle valve 36 connected to line 34 by line 38 to received working fluid 18 therefrom and by line 40 to return the fluid to the cooling system 30. The throttle valve 36 is operable from a fully closed to a fully open position typically by a user operating an associated handle. Of course, the throttle valve 36 may be operated by a motor or by other suitable means from a remote location if so desired. With the throttle valve 36 fully closed, the working fluid 18 proceeds from the flow divider 28 directly to the source 20 and more specifically to the fluid heater 32. With the throttle valve 36 open, working fluid 18 is diverted from the line 34 through line 38, the throttle valve 36 itself and the line 40 to the cooling system 30. Although the diverted fluid 18A could be returned to a reservoir or make-up-feed tank, it is preferred to return it to the cooling system 30 because at low power rates, the flow in the cooling system 30 needs to be supplemented as does the flow through the lubrication system 42. A separate make-up or supply line 39 is also shown so that additional working fluid may be added to the system at a location separate from the reservoir which is discussed hereinafter.

After the working fluid 18 is heated in the fluid heater 32, it proceeds via line 44 to a flow control module 45 and specifically to flow control valve 46. The flow control valve 46 operates between open and closed positions to regulate the flow rate of working fluid being supplied to a vapor generator 48 and in turn to the turbine 12. A sensing line 50 is connected to line 34 to supply working fluid 18 through an optional pulse damper 52 and through restrictors 54, 56 and 58 to the flow control module 45. The restrictor 54 supplies working fluid to a balance end 60 of the flow control valve 46 and to a pressure regulator 62. The pressure regulator of the flow control module 45 is set to maintain the pressure in the balance line 64 at about 175 pounds per square inch absolute (psia). The restrictors 56 and 58 supply working fluid 18 to opposite sides of a balance plate 66 that is attached to and that moves with a valve shaft 68. The working fluid is supplied to opposite chambers 70 and 72 with the pressure of the fluid in the chambers 70 and 72 acting on the plate 66. When a user wants to increase the power output of the turbine 12, the fluid heater 32 is operated as discussed hereafter to cause the temperature of the working fluid exiting the fluid heater 32 to be hotter and at a higher pressure. The pressure of the working fluid 18 acting on the piston 74 of pilot valve 76 causes the piston 74 to move overcoming the pressure on the balance end 78 thereby allowing the upper ring 80 to unblock or open the orifice 82 and causing the lower ring 84 to block its associated orifice 86. In turn the pressure of the working fluid in the chamber 70 decreases so that a pressure differential now exists between the fluids in the chambers 70 and 72. In turn the valve shaft moves toward the open position with the force on the balance end 60 being selected to regulate the rate or degree of movement of the valve shaft 68. Of course, system operation that leads to a lower temperature or pressure of fluid in line 44 causes the piston 74 of the pilot valve 76 to move to block orifice 82 and to unblock orifice 86 to cause the pressure in the chambers 70 and 72 to in turn cause the valve shaft 68 to move to reduce the flow toward the inlet to the turbine 12.

In FIG. 1, it can be seen that the flow control module 45 has at least one and preferably two pressure safety valves 88 and 90 which are here shown relieving to a waste location or overboard. Alternately, the valves 88 and 90 could each have a discharge 92 and 94 connected to a reservoir or make-up feed tank to save the working fluid being diverted.

The flow control module 45 may also have a deaeration line 96 connected to the line 44 to supply some working fluid through an optional flow restrictor 98 to a deaerator jet pump or an eductor 100. The jet pump 100 has a suction line 102 connected to the turbine 12 to extract gases that may collect in the turbine 12 over time. The working fluid 18C from the jet pump 100 is supplied via through a recovery line 104 and a check valve 106 to reservoir 108. The reservoir 108 may be positioned to impose a standing head (of pressure) on the system and is sized to be ample to make up for the expansion and contraction of the working fluid at different power levels. It is preferably sized to contain about 1.5 times the volume of working fluid 18 required for the entire turbine system 10 and is maintained about half full. The reservoir 108 also has a vent 110 so that unwanted gases collected by the jet pump 100 may exhaust. The reservoir 108 has a drain 112 so that the reservoir 108 may be drained if desired. The reservoir 108 has a make-up line 114 connected to supply working fluid 18 to maintain a desired volume of working fluid 18 in the turbine system 10.

The cooling system 30 shown in FIG. 1 receives working fluid 18 from the flow divider 28 via divider line 116. A heat exchanger 118 is connected to receive the working fluid 18 and cool it to a desired temperature. The heat exchanger 118 may be any suitable device that is configured to transfer heat to another medium. It is within contemplation that a cross flow radiator type device may be entirely suitable. However other configurations may be selected.

A thermostatically controlled mixing valve 120 is connected to receive the output of the heat exchanger 118 and to a bypass line 122 so that it can mix working fluid from the inlet side of the heat exchanger 118 and the outlet side of the heat exchanger 118 to supply the cooled working fluid 18D in a cooling line 124 through a pressure regulator 126 to the turbine 12.

The cooled working fluid 18D is injected into the turbine 12 proximate the fluid outlet 23 to lower the temperature of the exiting working fluid so that it does not flash as pressure changes occur during the pumping cycles of the turbine pump which is described hereinafter.

In FIG. 1, a lubrication system is shown in which cooled working fluid 18D is received in a lubrication line 128 and directed through a filter 130 which is here shown to be a 10 micron filter. Any suitable filter may be used as desired by the user. A bypass valve 132 and pressure relief valve 129 is shown connected so that if the filter 130 becomes blocked, clogged or otherwise acts to inhibit the flow of cooled working fluid, then it opens (e.g., at a differential pressure of 50 psi). Alternately, the bypass valve 132 may be manually operated to divert working fluid around the filter 130.

The cooled working fluid 18D is supplied from the filter to restrictors 134 and 136 which in turn are connected to supply the working fluid to the bearings that support the turbine 12 and also function as the seals for the turbine 12.

It is presently understood that the cooling system is desirable but not necessary particularly when the turbine of a system is being operated at a higher power level (e.g., above about 30%). Thus, a valve 138 that may be manually operated or operated by a solenoid may be provided in the cooling line 124 to stop the cooling flow from the heat exchanger 118 to the turbine 12 while still providing for lubrication of the bearings 140 and flow to seals 142 as desired.

Figure 2:
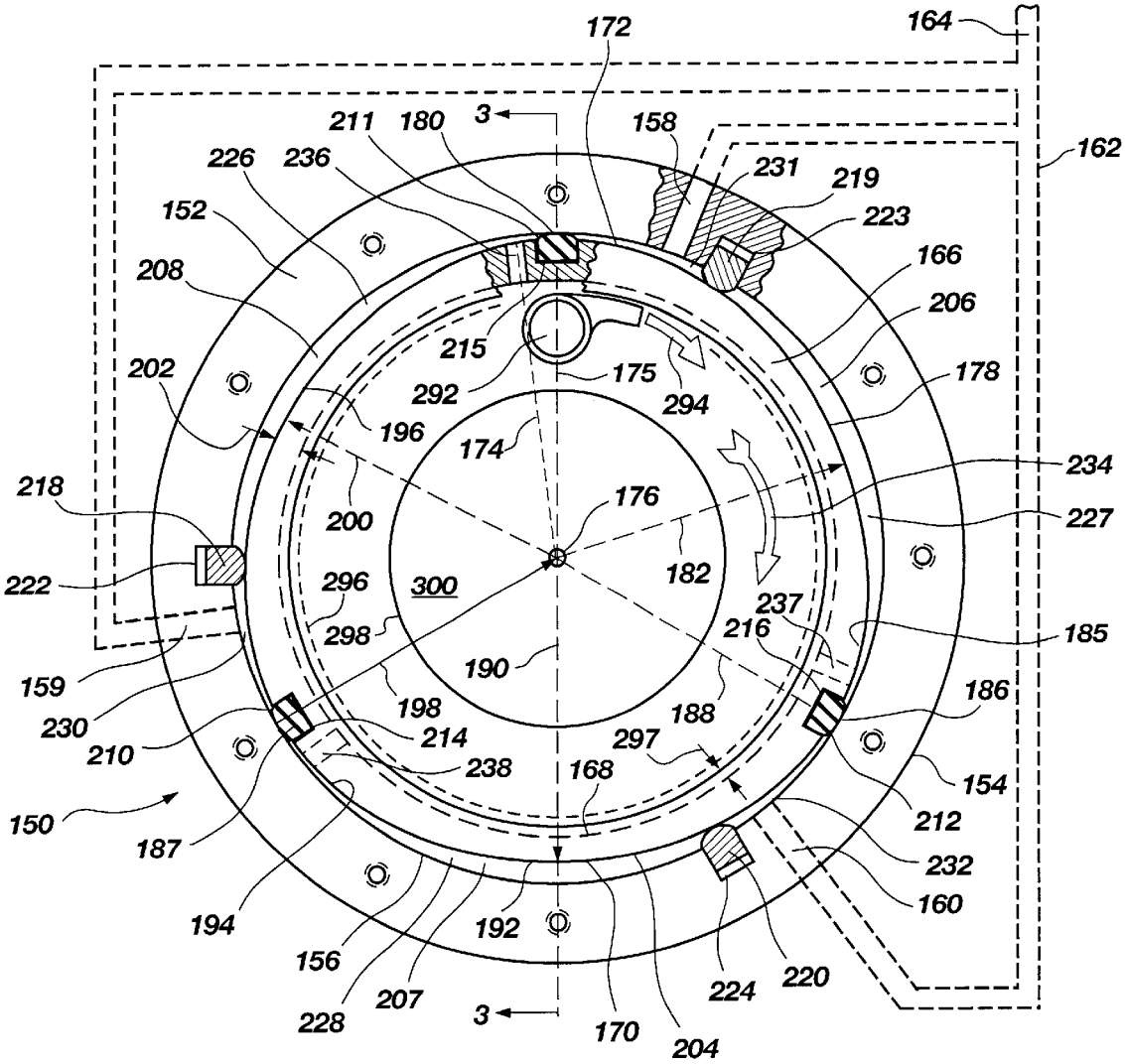
FIG. 2 is a cross sectional simplified depiction of a turbine for use in the turbine system of the present invention.

Turning to FIG. 2, a turbine 150 suitable for use as turbine 12 is depicted. A housing 152 has an outside surface 154 and an inside surface 156. Three apertures 158, 159 and 160 are formed in the housing 152 to extend from the inside surface 156 to the outside surface 154. The 158–160 are each sized for the passage of working fluid 18 (see FIG. 1) to the outlet 162 of the turbine 150. As here shown, the outlet is a series of lines show in phantom connecting the apertures 158–160 together and directing the working fluid into a discharge line 164.

The rotor 166 is here shown to have an inside surface 168 and an outside surface 170. The inside surface 168 is cylindrical in shape while the outside surface 170 is formed to have what is here termed to be several arcuate sections as hereinafter described. Specifically, the rotor outside surface 170 has a first arcuate section 172 which has a first effective radius 174 which extends from the rotor axis 176 to the outside surface 170. The radius 174 is described as an effective radius because the radius 175 of the first section changes from the one point 180 where it is the shortest. That is, the shortest radius of curvature 175 occurs between that point 180 and the axis 176 and is where the outside surface 170 is closest to the inside surface 156 of the housing 152. The radius of curvature on either side of that point 180, like radius 174, is larger and continues to increase the farther arcuately away one moves along the perimeter of outside surface 170 from the point 180. The first section 172 thus blends or extends into and is unitarily formed with a second section 178 in which the radius of curvature 182 is at its greatest and spaced a distance 182 from the rotor axis 176. The radius of curvature then continues to decrease until the second section 178 blends into and is unitarily formed with a third section 185 and the radius 188 is again at its smallest which is the radius at point 186. Again the radius increases to the radius 190 which is equal to the radius 182 for a fourth section 192. A fifth section 194 and a sixth section 196 are similarly formed with a short radius 198 and a long radius of curvature 200 equal to radius 188 and 190 respectively. Thus, it can be seen that the rotor 166 is formed with a wall thickness 202 that varies in a pattern from thick to thin with the thinnest portions each spaced 120 degrees radially from each other about the perimeter 204 of the rotor 166. Thus, three chambers 206, 207 and 208 are formed defined by the inside surface 156 of the housing 152, the outside surface 170 of the rotor and three rotating seals 210, 211 and 212.

The three rotating seals 210–212 are attached to and positioned in their respective grooves 214, 215 and 216 formed in the rotor 166. The rotating seals 210–212 are sized to snugly fit against the inside surface 156 while being made of material that is slidable over the inside surface 156 particularly when the working fluid (e.g., working fluid 18) is selected to have lubricating qualities. The three seals 210–212 are each spaced 120 degrees radially from the others and are located at the points 180, 186 and 187 where the radii 175, 188 and 198 are the shortest. The three seals 210–212 may be made from any suitable sealing material such as teflon or nylon. However the working fluid, such as working fluid 18, has lubricating characteristics and so that the seals 210–212 may be made of a polished or smooth metal such as steel.

Three stationary seals 218, 219 and 220 are positioned about the inside surface 156 of the housing and sized to contact the outer surface 170 of the rotor 166. The seals 218–220 are positioned in groves 222, 223 and 224 and are spring loaded. In turn, the seals 218–220 are urged outwardly from their respective grooves 222–224 to continuously contact the outer surface 170. The springs are not shown for clarity but may preferably be leaf springs positioned under each of the seals 218–220 along their length parallel to the rotor axis 176. Alternately, the stationary seals 218–220 may be urged outwardly by a plurality of coil springs positioned along the length to cause the stationary seals 218–220 to be urged uniformly against the outside surface 170 of the rotor 166. Alternately, a sponge rubber or closed cell neoprene spring may be used with each of the stationary seals 218–220 which are preferably made of polished steel but may be made of any suitable bearing material including teflon and nylon.

The stationary seals 218–220 each are positioned 120 degrees radially from each other and act to divide each of the three cavities 206–208 into a suction cavity 226, 227 and 228 and a pressure cavity 230, 231 and 232. As the rotor 166 turns clockwise direction 234, the rotating seals 210, 211 and 212 pass over stationary seals 218, 219 and 220. As the rotating seals 210–212 continue to rotate, the chambers 206–208 begin to divide into the suction cavities 226–228 and the pressure cavities 230–232. That is, the pressure cavities 230–232 are clockwise between the rotating seals 210–212 and the stationary seals 218–220 and become smaller in volume as the rotor 166 turns clockwise pressing and positively displacing the working fluid in the pressure cavity 230–232 out through respective apertures 158–160. Similarly the suction cavities 226–228 are becoming increasing larger creating a lower pressure or suction so that working fluid on the inside of the rotor 166 is urged outwardly through respective apertures 236, 237 and 238 and into the suction cavities 226, 227 and 228. Thus, as the rotor 166 rotates clockwise, it can be seen that the three chambers 206–208 repeatedly are formed into the suction cavities and pressure cavities to effect a positive pumping action to pump the working fluid from inside the rotor 166 through the outlet 162 to the discharge 164.

Figure 2A:
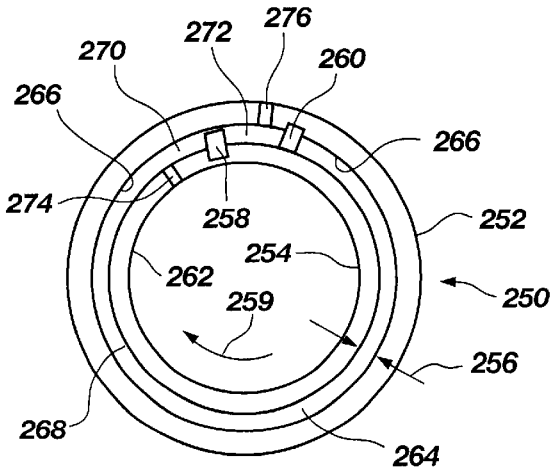
FIG. 2A is a simplified cross sectional depiction of an alternate turbine for use in the turbine system of the present invention.

While the rotor 166 here shown has an outer surface 170 formed with varying radii of curvature, it should be understood that a turbine 250 may be constructed such as that depicted in FIG. 2A with a housing 252 that is cylindrical and a rotor 254 that is also circular in cross section and an appropriate gap 256. FIG. 2A shows a single rotating seal 258 and a single stationary seal 260. Any imbalance can be off set by placing a counter weight on the inside surface 262 of the rotor 254. A pump chamber 264 is defined by the inside surface 266 of the housing 252, the outside surface 268 of the rotor 254. The chamber 264 is divided into a suction cavity 270 which is becoming larger (in volume) as the rotating seal 258 rotates in a clockwise direction 259 and a pressure cavity 272 that is becoming smaller urging fluid from the inside of the rotor 254 through aperture 274 and discharged through aperture 276 to a discharge line in an associated discharge system. That is, the turbine 250 of FIG. 2A is shown with one chamber 264.

Figure 2B:
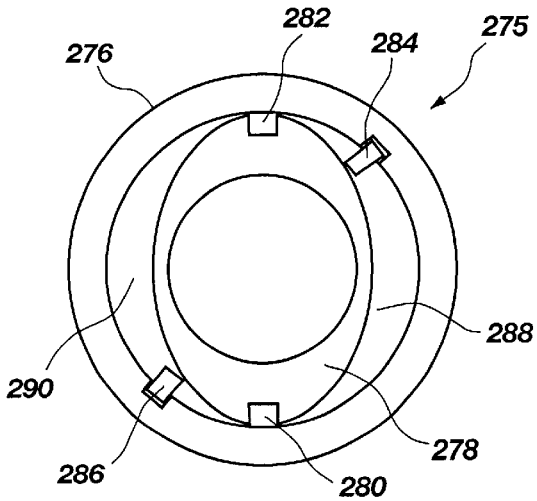
FIG. 2B is a simplified cross sectional depiction of an alternate turbine configuration for use in the turbine system of the present invention.

In FIG. 2B, a turbine 275 is shown with a housing 276 and a rotor 278. The rotor 278 is provided with two rotating seals 280 and 282 comparable to rotating seals 210–212. The housing 276 has two stationary seals 284 and 286 that are comparable to stationary seals 218–220 and spring loaded in the same manner. The turbine 274 has two pump chambers 288 and 290 comparable to chambers 206–208. The chambers 288 and 290 are divided into suction and pump cavities the same as the chambers 206–208 with the rotor being configured to have 4 sections having different radii of curvature as explained in reference to the chambers 206–208.

From the configurations of FIGS. 2, 2A and 2B, it may be understood that a turbine may be constructed with one or more chambers each of which is divided into a suction cavity and a discharge cavity by stationary and rotating seals. At present it is believed that turbines may be constructed with as few as one and with many chambers (e.g., 12) based on the size of the turbine.

In FIG. 2, the outer surface 170 is shown with a varying radius of curvature. It should be understood that the outer surface 170 could be formed to have other shapes or forms including even a portion that is alternating concave and convex. That is, a rotating seal could be mounted along a concave portion with a convex portion clockwise and counter clockwise from the concave portion to form a larger chamber for pumping the working fluid.

In FIG. 2, a nozzle 292 is shown positioned in the rotor 166. A working fluid is discharged by the nozzle 292 in a clockwise direction 294 to contact a boundary layer 298 of working fluid formed on the interior surface 168 of the rotor 166. The resulting drag induces the rotor 166 to rotate in the clockwise direction 234 and produce useful mechanical energy as further discussed hereinafter. A source of working fluid 298 is also shown in phantom in the interior of the rotor 166 along with a combustion chamber 300, all as discussed further hereinafter.

Figure 3:
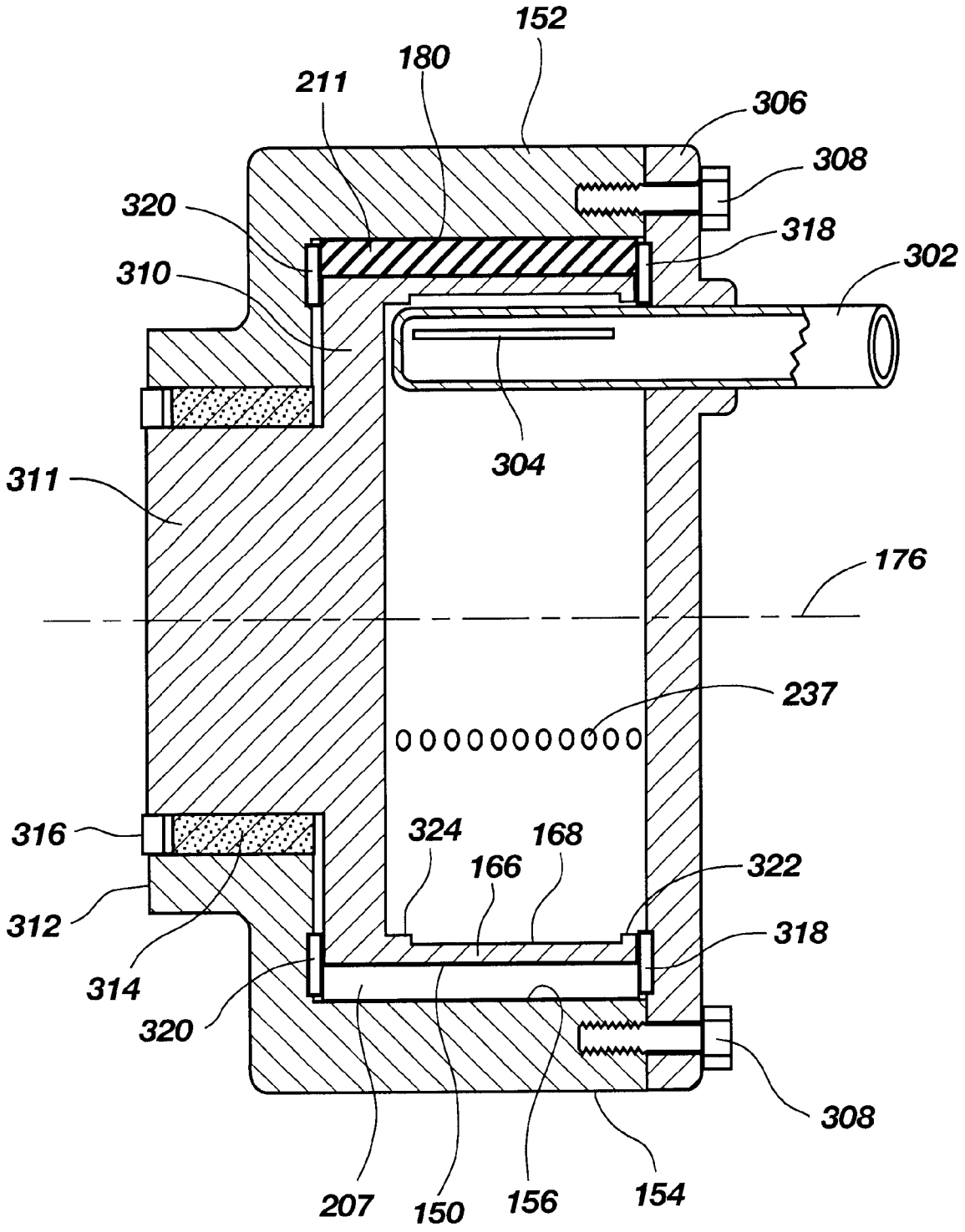
FIG. 3 is a cross sectional simplified depiction of the turbine shown in FIG. 2.

FIG. 3 is the turbine of FIG. 2 without the source of working fluid 299 shown. Rather the working fluid is received from a separate source of working fluid (not shown) and supplied via a line 302 that directs the working fluid out through nozzle 304. In FIG. 3, it can be seen that an end plate 306 is held to the housing 152 by an appropriate number of bolts 308 positioned about the perimeter of the end plate 306. The rotor 166 is formed with a hub 310 that extends inward from the rotor 166 and connects to an output shaft 311. The rotor 166, hub 310 and output shaft 311 are shown to be unitarily formed.

The housing 152 in FIG. 3 has a bearing support 312 that retains a bearing 314 of any suitable or desired configuration to rotationally support the output shaft 311. Appropriate seals 316 may be provided separately to seal the working fluid into the turbine. Alternately seals may be formed as part of the bearing 314. O-ring seals or other mechanical seals including labyrinth seals may be used for selected applications.

FIG. 3 also shows rotor seals 318 and 320 positioned on opposite ends of the rotor 166 to effect a seal and retain the working fluid in the chambers of the pump. The seals 318 and 320 also function as thrust bearings. The rotor 166 inside surface 168 may be formed with a small lips 322 and 324 on either end of the rotor 166 to retain the boundary layer. In given turbines, the boundary layer 296 may be thicker than the height 297 of the small lip shown.

Figure 4:
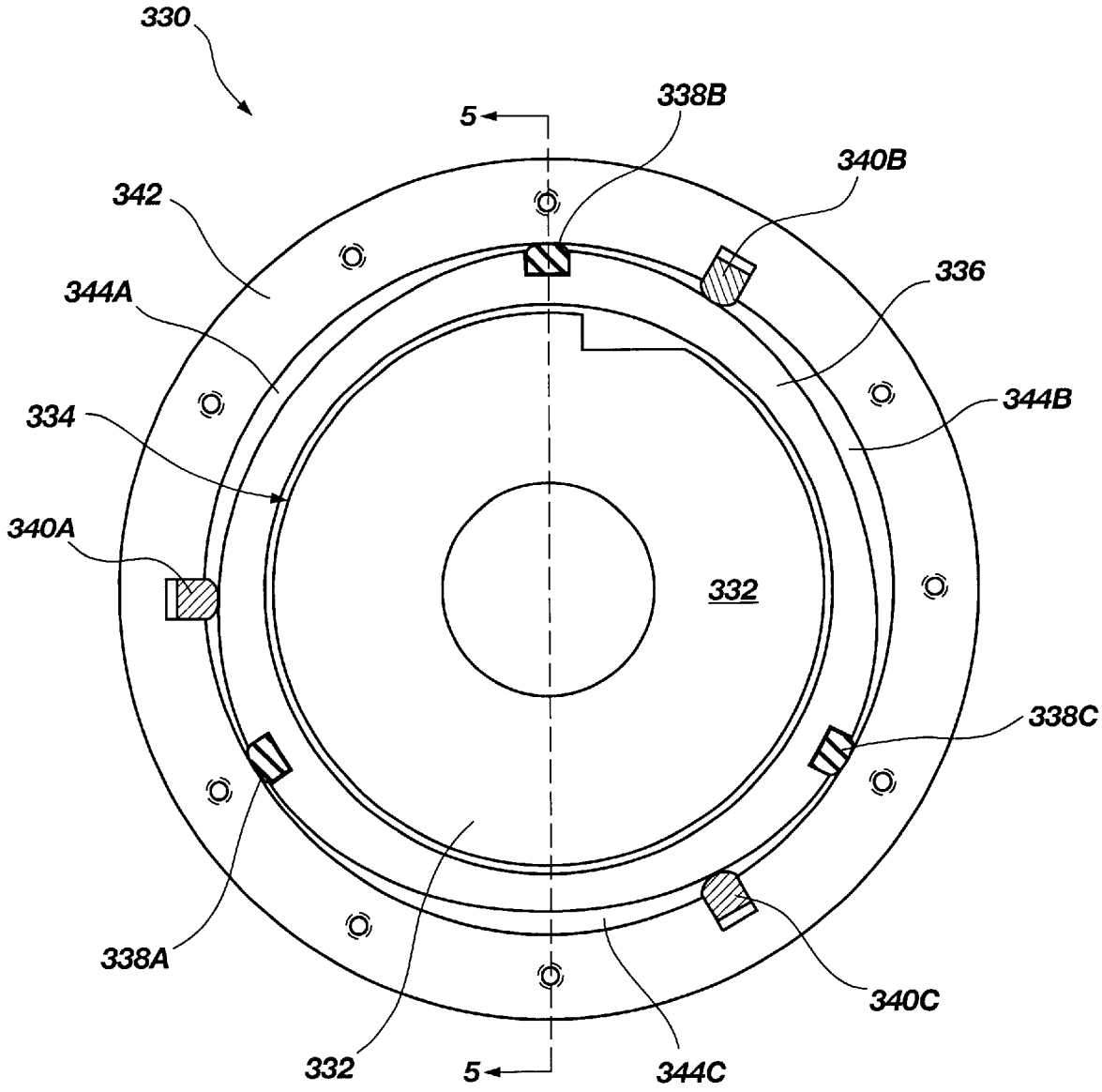
FIG. 4 is a cross sectional simplified depiction of a turbine with a vapor generator of the turbine system of the present invention.
Figure 5:
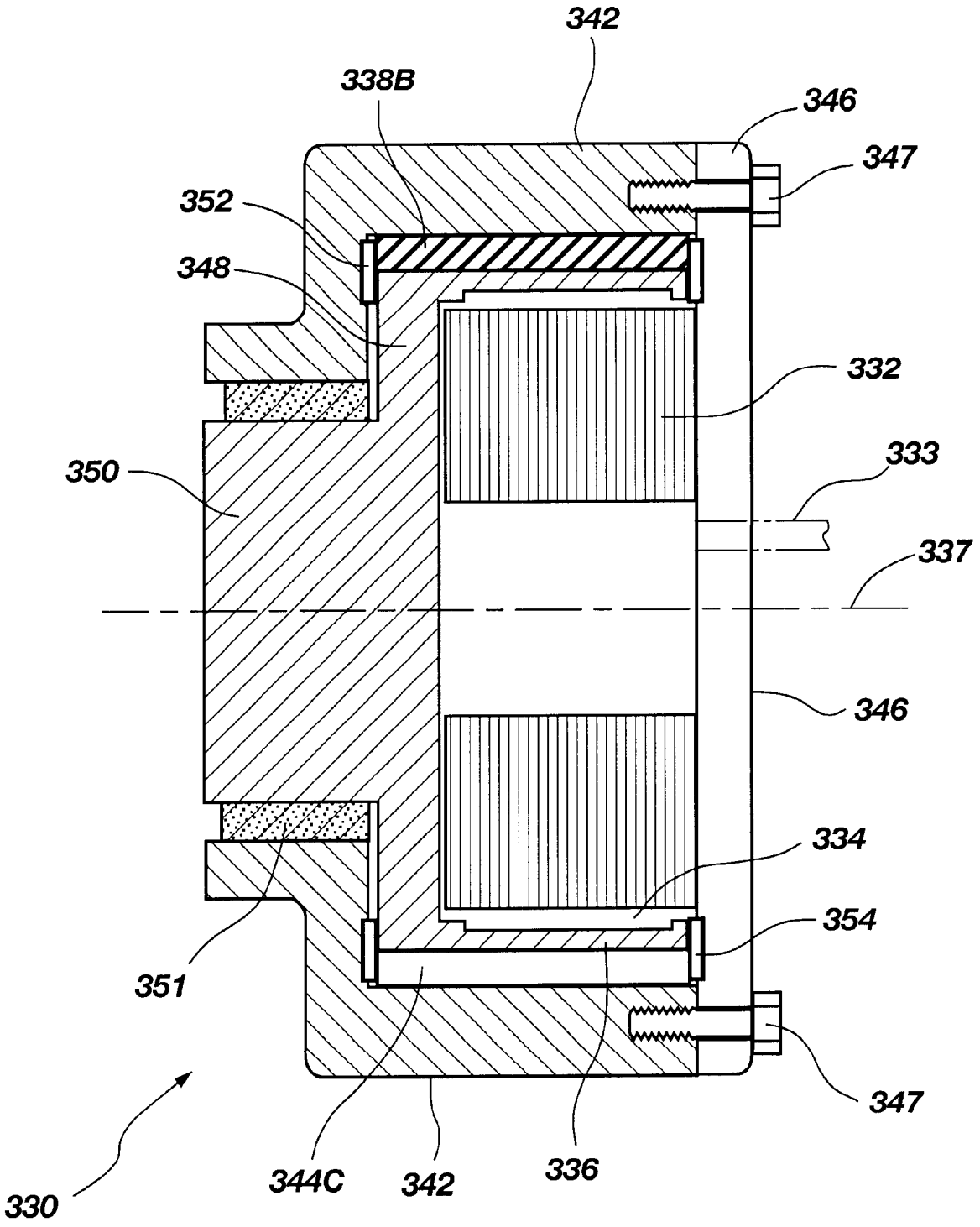
FIG. 5 is a cross sectional simplified depiction of the turbine shown in FIG. 4.

FIGS. 4 and 5 depict an alternate turbine 330 similar in construction to the turbine 150 of FIGS. 2 and 3 with the source of working fluid 332 within the interior 334 of the rotor 336. The rotor 336 has rotating seals 338A–C and fixed seals 340A–C comparable to the rotating seals 210–212 and the stationary seals 218–220 of FIGS. 2 and 3. The rotor 336 is positioned within a housing 342 to form pump chambers 344A–C. The source of working fluid 332 is centrally positioned and fixedly secured to the end plate 346 that is secured to the housing 342 by a plurality of bolts 347. The rotor 336 has an axis 337 and is connected to a hub 348 which is in turn connected to the drive axle 350 that is supported by a bearing 351. The rotor 336 also has rotor seals 352 and 354 which are comparable to seals 318 and 320. The rotating seals 338A–C and stationary seals 340A–C as well as the rotor seals 352 and 354 may be made of an appropriate metal like polished stainless steel lubricated by the working fluid. The source of working fluid 332 is more specifically detailed in FIG. 6. The air and fuel supply lines and the exhaust lines 333 are shown in more detail in FIG. 6.

Figure 6:
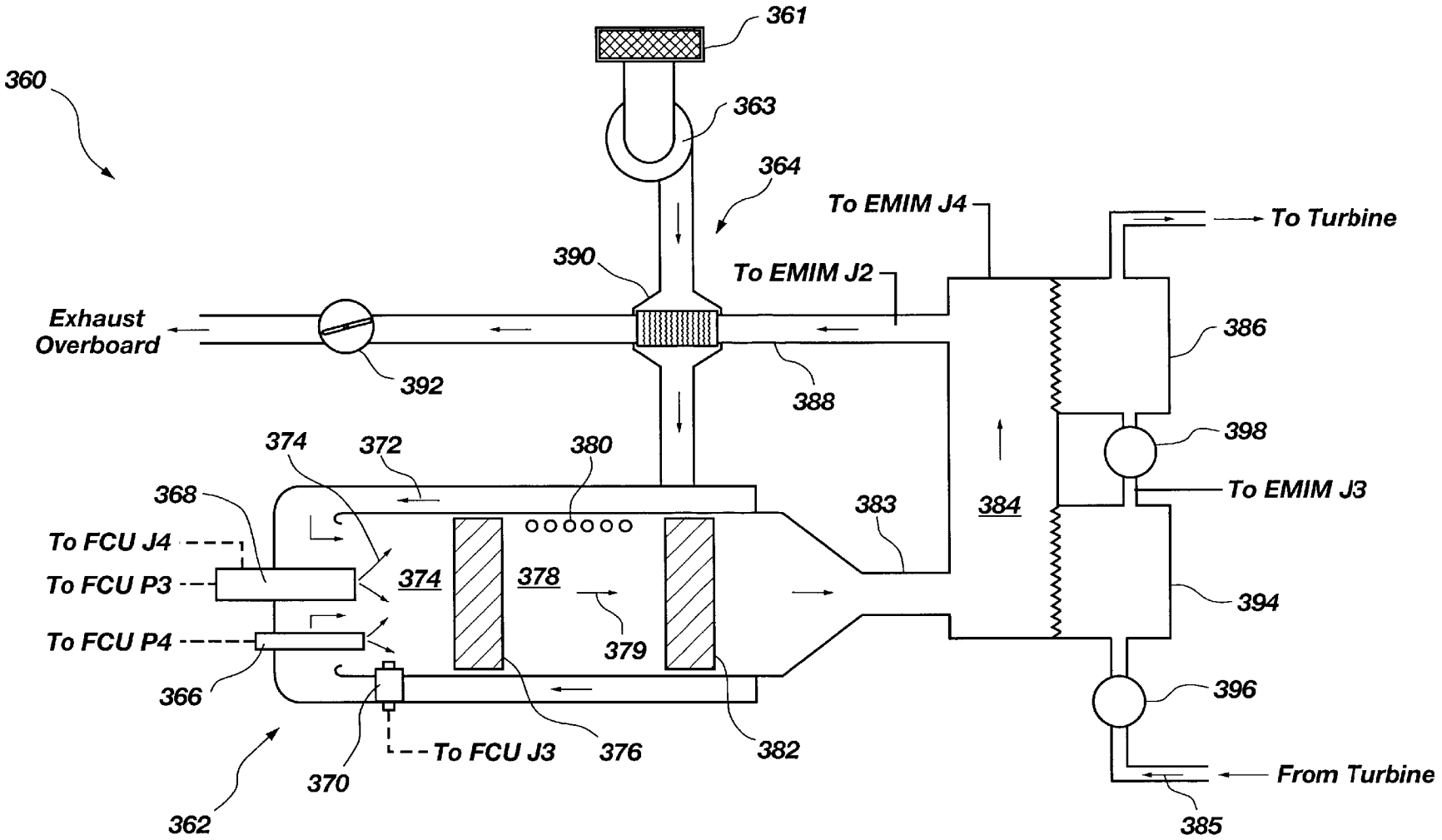
FIG. 6 is a schematic of a source of working fluid for use with the turbine system of the present invention.

In reference to FIG. 6, a source of working fluid 360 is depicted in schematic form. A combustion unit 362 receives air from an air supply system 364 and fuel from a fuel system through idle injector 366 and main injector 368. There is an ignition source to ignite the air-fuel mixture in the form of glow plug 370. Air 372 from the air supply system 364 and fuel from the idle injector 366 and the main injector 368 are mixed and burned in a primary combustion chamber 374. The combustion gases pass through the primary catalytic converter 376 into a secondary combustion chamber 378. Additional air is supplied through secondary combustion air ports 380. The combustion gases 379 then pass through a secondary catalytic converter 382 and a throat 383 into a heat exchange region 384 in which the heat from the combustion gases is transferred to the working fluid. The working fluid then passes through a vapor generator 386 and out a nozzle as discussed hereinafter. The combustion gases are exhausted through an exhaust line 388 and through a regenerator or heat exchanger 390 that preheats the air passing through the air supply system 364. A discharge damper 392 is provided so that a user may regulate the flow rate of gasses out of the combustion chamber 362.

The fluid heater 394 illustrated in FIG. 6 depicts any suitable heat exchanger by which heat from the combustion chamber 362 is transferred to the working fluid 385. The heat exchanger may be of any suitable type or form but is preferably a cross flow system. However any other suitable system may be used as desired. As shown, the heated working fluid 385 then flows through the flow control module 45 (see FIG. 1) and more specifically the flow control valve 46 before it passes into the vapor generator 386. Optional isolation valves 396 and 398 are also shown in FIG. 6.

Figure 7:
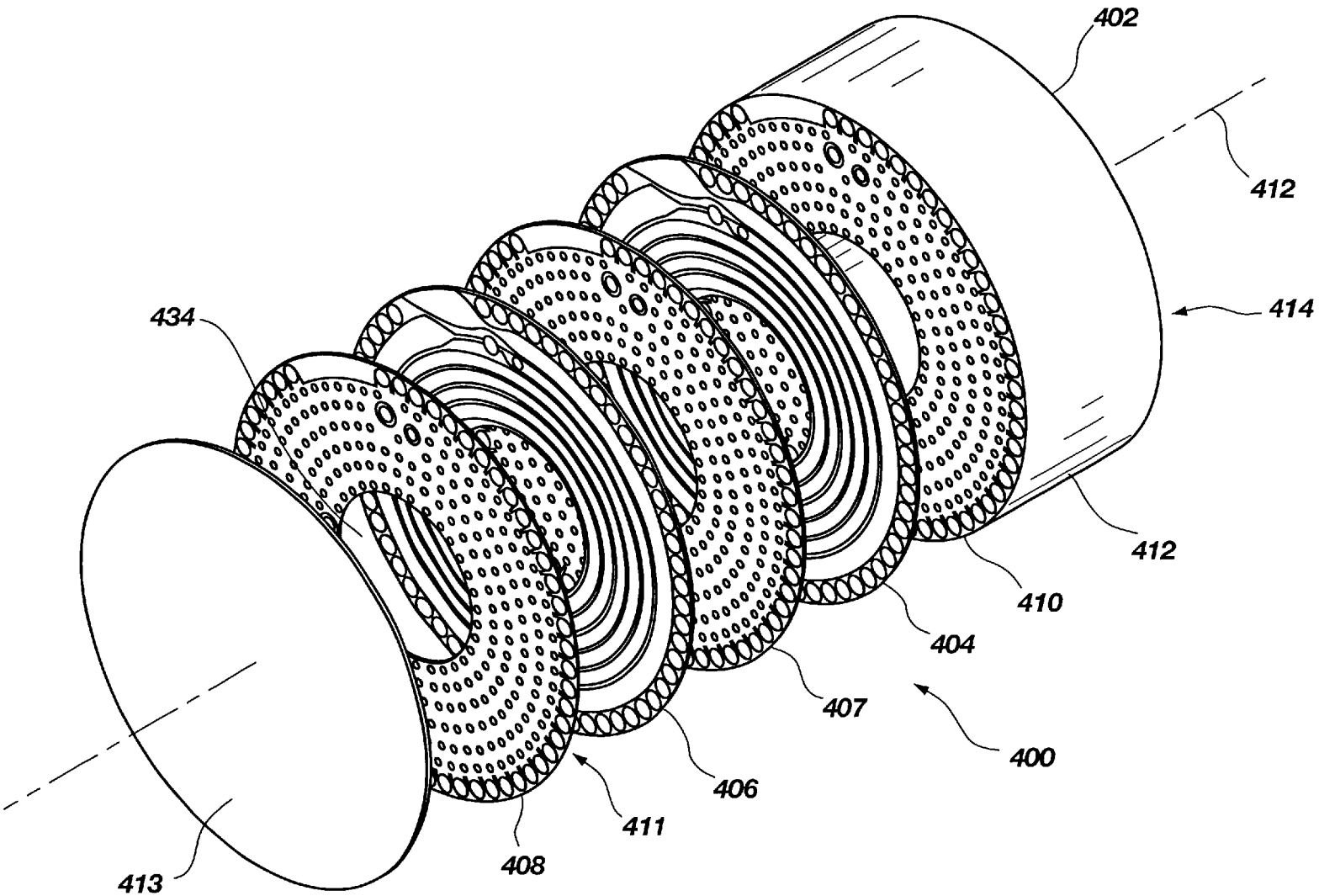
FIG. 7 is an exploded view of a fluid heater for use with the turbine system of the present invention.
Figure 9:
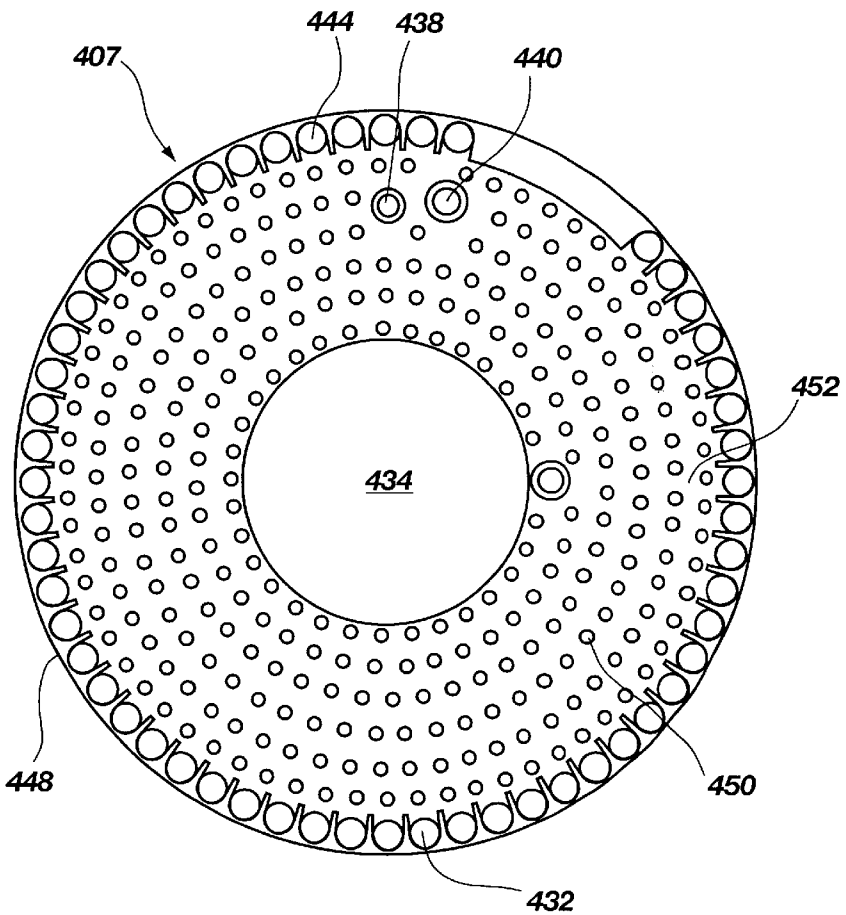
FIG. 9 is a planar view of a gas plate for use in the fluid heater of FIG. 6.
Figure 8:
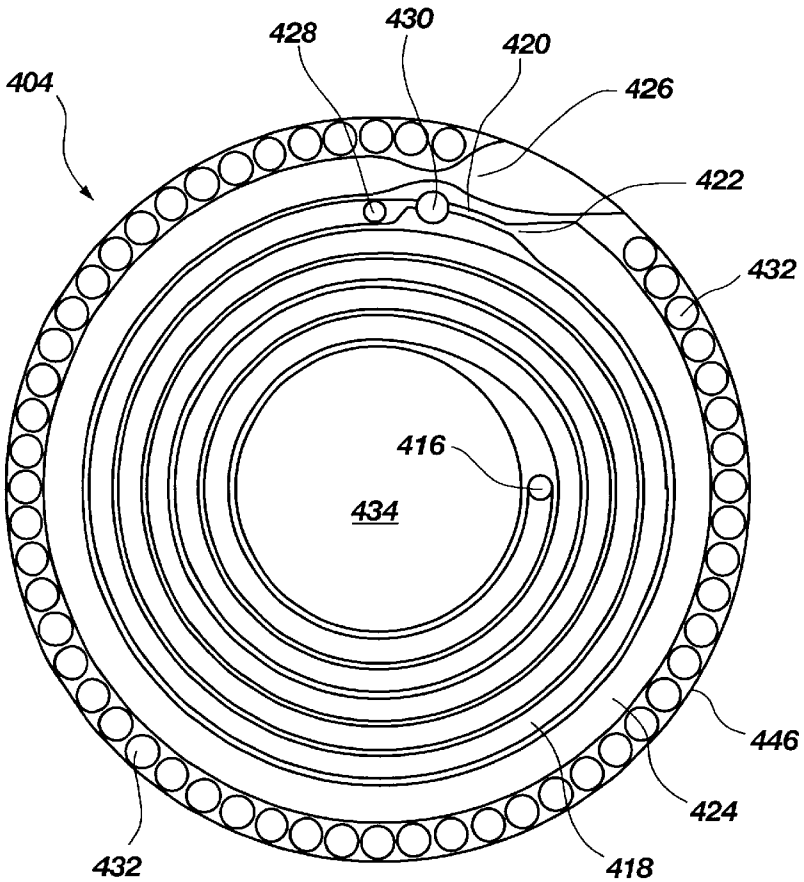
FIG. 8 is a planar view of a fluid plate for use in the fluid heater of FIG. 6.

A suitable vapor generator 400 is shown in FIGS. 7, 8 and 9. A cylindrical generator housing 402 contains a plurality of fluid plates 404, 406 and a plurality of gas plates 408, 409 and 410 all positioned along the axis 412 of the generator 400 which is typically coaxial with the axis of a turbine in which a combustion chamber and vapor generator are installed. For example, the axis 412 may be coaxial with the axis 176 of turbine 150 of FIG. 2. The vapor generator 400 here shown has from about 4 to about 8 fluid plates 404 and 406 and a corresponding number of gas plates such as plates 408–410. In some applications, one additional gas plate may be provided. The plates are all positioned in the cylindrical generator housing and alternate in a sandwich fashion generally as shown. It is presently believed the plates 404, 406, 408–410 are press fit into the cylindrical generator housing 402 and then joined together with the wall 412 of the generator housing 402 by a heat process that results in a weld-like association of the plates and the cylindrical generator housing 402. Of course the cylindrical generator housing 402 is sized to fit within the rotor of a turbine and thus is sized in relation to the size of the rotor and turbine with which it is associated. An end cap or end plate 413 is positioned over the last or outer most gas plate 408 of the vapor generator and a similar end plate is positioned over the opposite end 414 to provide a sealed interior that is in effect a heat exchanger for transferring heat from the combustion gas to the working fluid 385.

A fluid plate 404 or plate 406 is shown in FIG. 8. It has an inlet port 416 which receives the working fluid 385 from the discharge line 22 (FIG. 1) and through a flow control valve 45. The working fluid 385 then passes into a spiral channel 418 that terminates in a throat 420 that discharges through an expansion point 422 and into a vapor passage 424 and from the vapor passage through a nozzle 426 for discharge into the turbine within the rotor directed at the boundary layer. The channel 418 is formed by the indentation formed in the fluid plate 404 and the back surface 411 of the gas plate positioned immediately in front of the fluid plate such as fluid plate 404. A fluid pressure balance port 428 is provided and connected through to the next fluid plate so that the pressure in the working fluid from fluid plate to fluid plate remains essentially the same. A separate fluid control port 430 is also provided to control the flow to each expansion channel in the interior of the vapor generator 400. A plurality of exhaust ports 432 are positioned about the outer portion of the vapor generator plates like plate 406 so that combustion gases are supplied through the center channel 434 and along the surface 452 of the gas plate so that the combustion gases may pass outwardly to and enter the exhaust ports 432 and may return for discharge into the exhaust line 388.

The gas plate such as plate 407, shown in FIG. 9 is sized to be substantially the same as the fluid plate 404. The gas plate 407 has a balance port 438 with a small extension so that it connects with the port 428. In turn working fluid can pass therein and pass from the channel 418 to another plate like from the channel in plate 406 to the channel in plate 404. Pressure differentials across the fluid plates are therefor at a minimum. The fluid plate 404 is preferably made of a suitable metal with the groove 418 and the vapor passage 424 both concave indentations made in the surface. As stated, the fluid plate 404 and other fluid plates have a sealed channel formed to be a snug or tight association of the gas plate 407 with the adjoining gas plate. The working fluid flows through the sealed channels 418 and 424.

The port 440 is also provided to extend through the space between the back side 441 of the fluid plate 404 and connect to the port 430 of the gas plate. The exterior rim has ports 444 that interconnect with the ports 332 to form the exhaust ports or channels along the outside perimeters 446 and 448. The gas plates like plate 407 have turbulence means which are here shown to be rows of raised buttons 450 of substantially the same type and dimension. As here hown the buttons 450 are small cylindrical extensions which extend up from the surface 452 of the gas plate and are placed in concentric rows extending outwardly from the center. The buttons function to stir the exhaust cases as they pass from the interior 434 outwardly in between adjoining fluid plates and the gas plates like plates 406 and 408.

Although the vapor generator 400 here shown is sized for positioning in the rotor of a turbine, it is to be understood that a vapor generator may be positioned outside of the rotor and outside of the turbine housing in selected applications.

Figure 10:
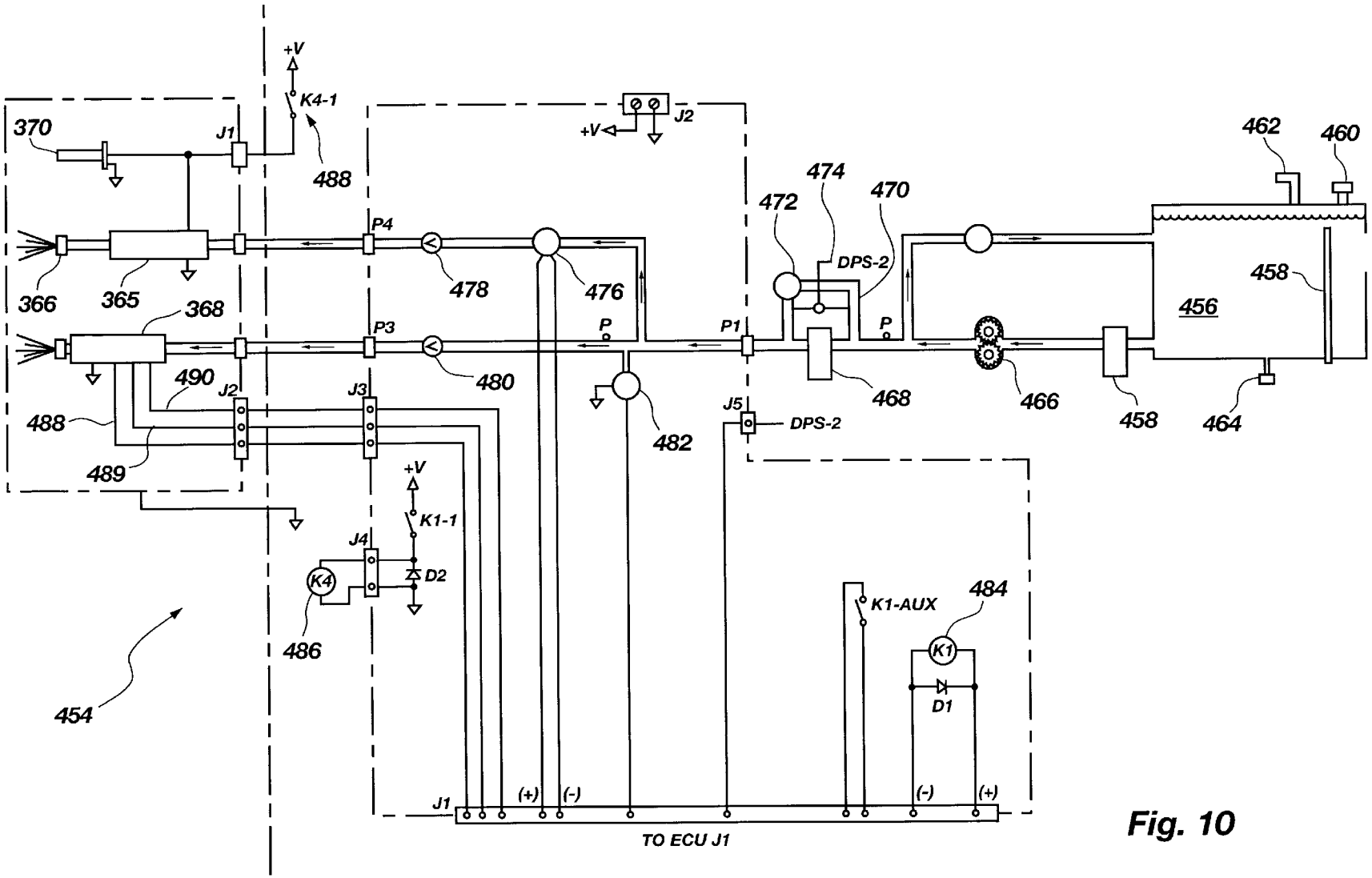
FIG. 10 is a schematic of a fuel system for use with the turbine system of the present invention.

Turning now to FIG. 10, a fuel system 454 is shown with a fuel tank 456. The tank 456 has a level sensor 458, a filler cap 460, a vent 462 and a drain 464. The fuel proceeds from the tank 456 and through a fuel filter 458 to a gear pump 466. Fuel proceeds through a filter 468 that has a bypass line 470 and a bypass valve 472 operable to bypass the filter 468. A separate pressure sensor is also shown so that a user may monitor the pressure drop across the filter 468 and in turn monitor the status of the filter 468. The fuel is then supplied to the idle nozzle 366 through an idle needle valve or metering valve 476 and a check valve 478. Fuel is also supplied directly through a check valve 480 to the main injector 368.

FIG. 10 also shows a low pressure switch 482 connected to send an alarm to a remote location to alert operators that the fuel pressure is low. A glow plug starter relay 484 which operates to activate or close a glow plug relay 486 which in turn causes power to be deliver through relay switch 488 to the glow plug 370. Also shown are conductors 488–489 and 490 separately connectable to a remote controller to regulate fuel flow through the main injector 368.

Figure 11:
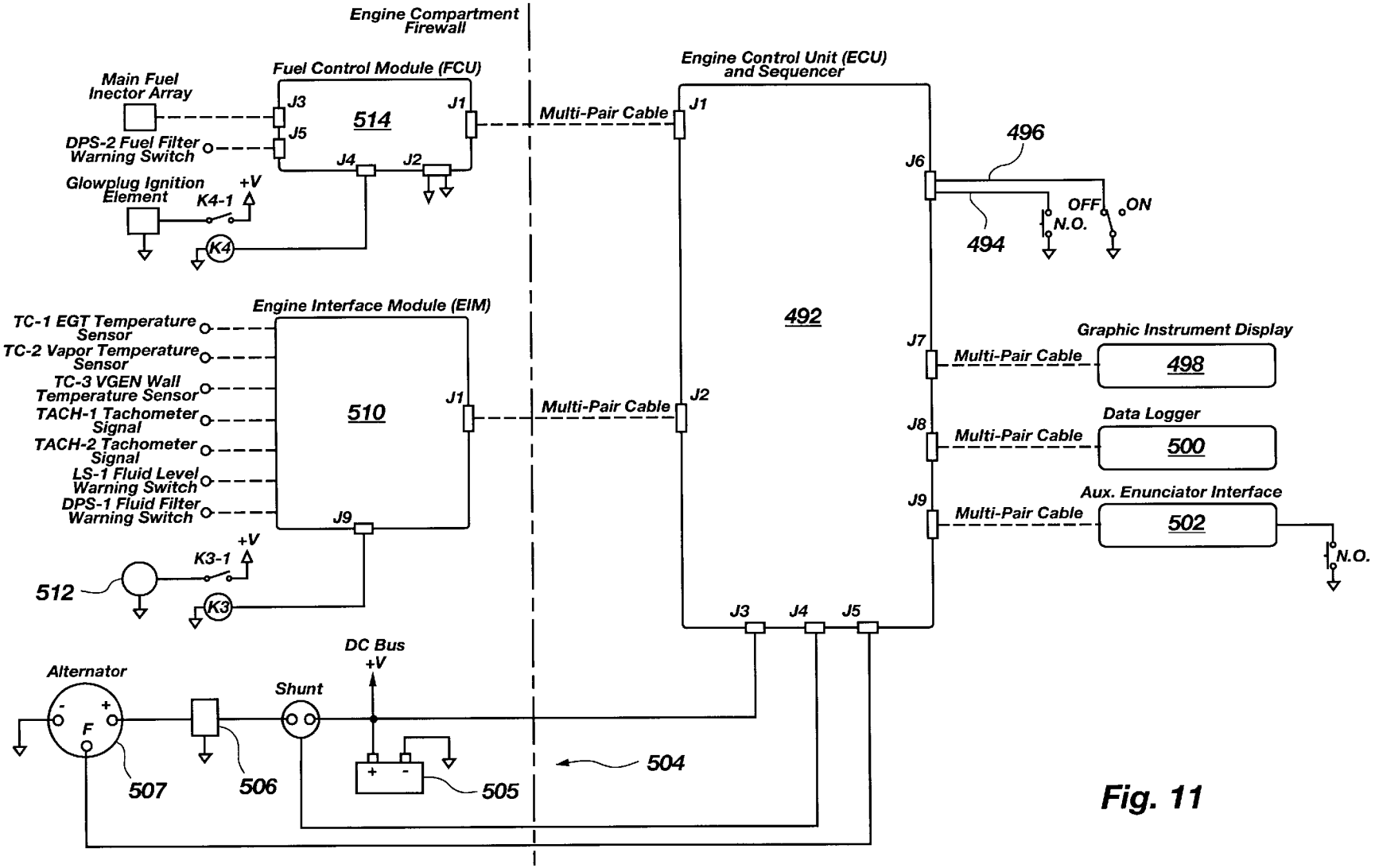
FIG. 11 is a schematic of an electrical system for use with the turbine system of the present invention.
Figure 12:
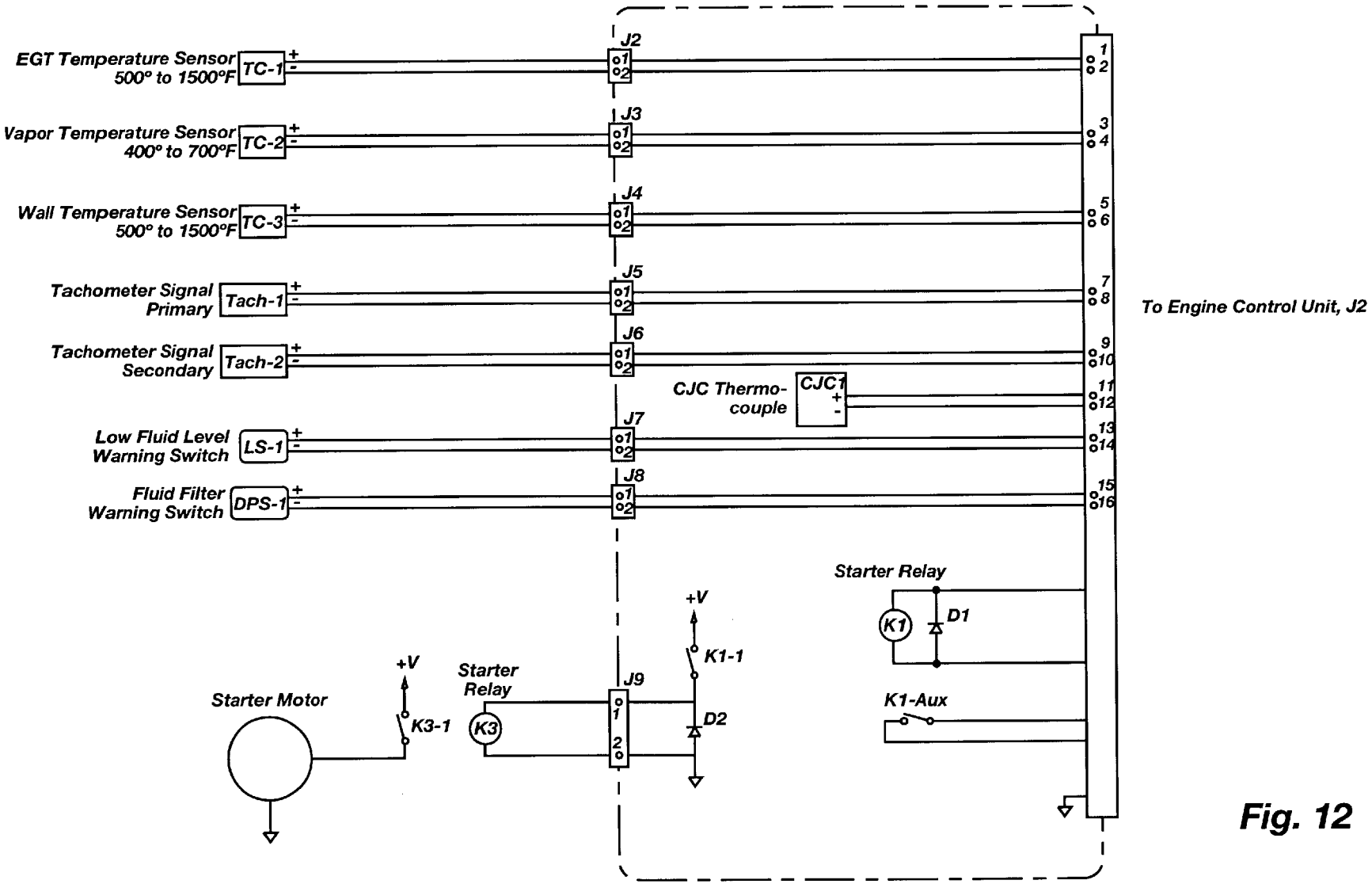
FIG. 12 is a schematic of an electrical interface circuit for use with the turbine system of the present invention.

An engine control unit 492 is depicted in FIG. 11. It may be any suitable computer like device configured to operate the turbine. The engine control unit 492 is configured to receive an on-off signal and a start signal via conductors 494 and 496. Outputs may be provided to instruments 498, to a data logger 500 and to an alarm panel 502. Connections are provided to a typical electrical system 504 having a battery 505, an alternator 507, and a voltage regulator 506. An engine interface module 510 is show with connections to receive sensor input as shown here and in FIG. 12. The Engine Interface Module is also connected to operate the starter 512. A fuel module 514 is provided to operate the fuel injector 368 and other components of the fuel system while at the same time receiving input from the fuel system filter differential pressure detector 474.

Figure 13:
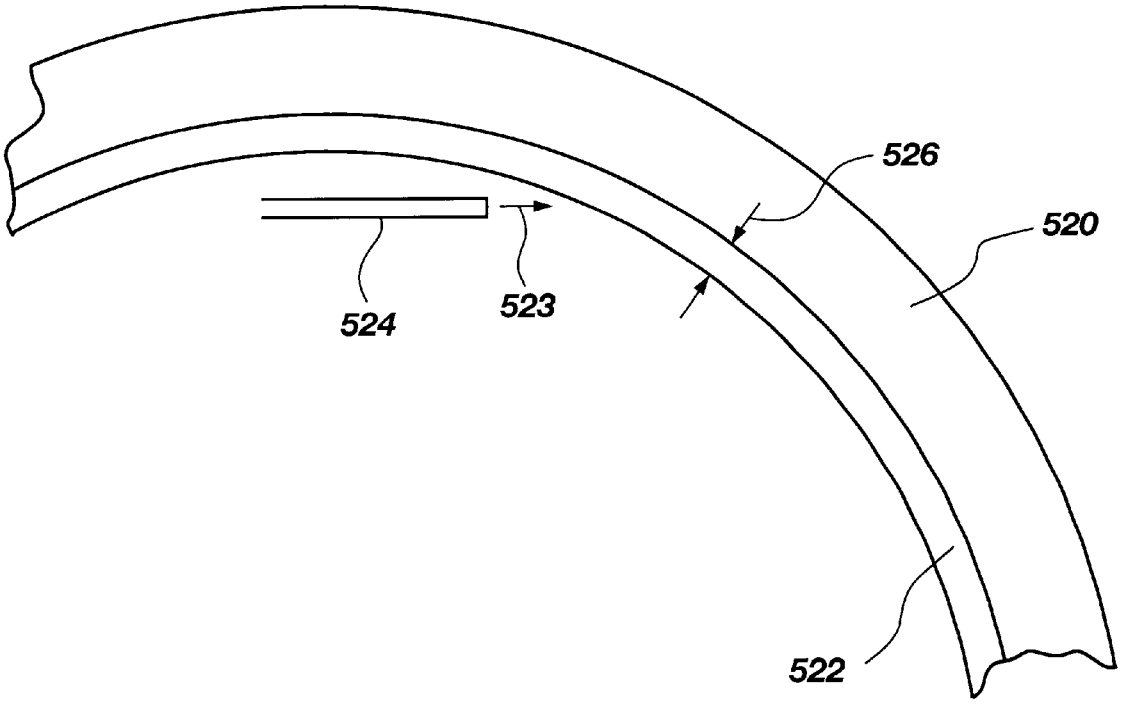
FIG. 13 shows a rotor being driven by a nozzle.

In operation, it should be understood that a turbine of the type herein described has a rotor 520 as shown partially in FIG. 13 that rotates at a speed sufficient to retain a boundary layer of working fluid 522 thereagainst. The working fluid 523 is typically exhausting from the nozzle 522 as a vapor which drags across the boundary layer 522. The drag is sufficient to apply a force through the layer to the rotor 520 and in turn induce rotation. At the same time the speed of the vapor will slow as the kinetic energy is delivered to the boundary layer and at the same time it will thereby start to condense to become a liquid and add to the boundary layer 522. The level of the boundary layer is maintained by allowing the liquid to be pumped out of the interior by the pumping arrangements hereinbefore discussed. By use of an appropriate working fluid which is any suitable aeromatic hydrocarbon, a temperature and pressure profile can be maintained to cause operation with the boundary layer. Further such a working fluid is preferred because it can lubricate as discussed hereinbefore. A diethel benzine fluid is preferred. Diphenal ethane may also be used.

To start a turbine system 10 such as that disclosed in FIG. 1, the turbine 12 may be assumed to be at a stand still or stopped with the interior containing working fluid 18. In some shut down conditions, the turbine 12 may be deemed to be full of working fluid 18 at ambient temperature and pressure. Electrical power is then turned on or made available to all engine controls by manipulating provided engine controls to supply power as necessary. Specifically electrical power is made available to all engine control systems by placing the Engine ON/OFF Switch in the ON position to supply power via conductor 496 of FIG. 11 to the engine control unit 492. Activation of a start button itself supplies power via conductor 494 to start the Engine as hereinafter discussed. Specifically, the start switch of FIG. 11 initiates an automatic start sequence that has been programed into the engine control unit 492. The engine control unit 492 sends signals to start or engage the starter 512 via the engine interface module 510. The starter motor 512 connects to the turbine rotor like rotor 166 (FIG. 2) via a suitable clutch and drive train to cause the rotor like rotor 166 to spin at a rate sufficient to develop a centrifugal force within the working fluid contained therein to establishes a stationary boundary layer (FIG. 13) as the pump portion of the rotor, like rotor 166 pumps the working fluid out of the interior of the rotor and develops sufficient flow rate.

When the rotor, like rotor 166, reaches a predetermined speed, the engine control unit 492 sends an electrical signal via the fuel control unit 514 to activate the glowplug 370 (FIG. 10) and the fuel heater 365 which heats the fuel to facilitate atomization. After sufficient time has elapsed to allow the glowplug 370 and fuel heater 365 to reach full operating temperature, the engine control unit 492 sends an electrical signal to the fuel control unit 514 to open the start and idle fuel metering valve 476 which allows fuel to flow via the fuel heater 365 to the start/idle fuel nozzle 366 which is then ignited by the glowplug 370. The engine control unit 492 also activates the fan 363 which draws air from ambient through air filter 361 and supplies the air 372 to the first combustion chamber 374 to begin the combustion process.

After sensing a sufficient temperature rise in the exhaust air via thermocouple probe TC-1, the engine control unit 492 sends an electrical signal to the fuel control module to deactivate the glowplug 370 and fuel heater 365.

The vapor generator will begin to generator working fluid 385 vapor which will flow from the nozzle like nozzle 292 or 304 to impart a rotational force to the rotor like rotor 166 to cause it to increase in speed. When the rotor speed has increased to a predetermined level (e.g. 60% of a minimum operational rotational speed (RPM), the engine control unit 492 sends an electrical signal to the engine interface module 510 to disengage the starter motor 512. The engine control unit 492 has also activated the other sensors and the fuel pump 466 so that continued operation will proceed until the fuel supply is shut off allowing the turbine to slow down and come to a stop. In the interim, operation of the turbine such as turbine 12 is effected by controlling the fuel supply to the injectors 366 and 368 to in turn control the temperature and volume of the combustion gases heating the working fluid like fluid 385. In turn the vapor generator supplies fluid at higher temperatures and pressures to change the RPM or the power out of the turbine as desired. The throttle valve 36 is also useful to regulate the flow rate of the working fluid like fluid 18 in FIG. 1.

Those skilled in the art will recognize that the specific embodiments discussed herein are not intended to limit the scope of the claims which themselves recite those features regarded as essential to the inventions.

I claim:

1. A turbine system comprising:

a source of working fluid;

a housing having a housing interior surface and a housing exterior surface, said housing being formed to contain working fluid there within;

a first aperture formed in said housing to extend between said housing interior surface and said housing exterior surface, said first aperture being sized to communicate working fluid in liquid form from said housing interior surface to said housing exterior surface;

a rotor mounted to rotate within said housing, said rotor having a rotor interior surface and a rotor exterior surface;

a second aperture formed in said rotor to extend between said rotor interior surface and said rotor exterior surface, said second aperture being sized to communicate working fluid in liquid form from said interior surface to said exterior surface;

nozzle means connected to receive said working fluid from said source of working fluid and positioned to direct said working fluid relative to said rotor interior surface to urge said rotor to rotate relative to said housing; and pump means positioned between said housing interior surface and said rotor exterior surface for pumping said working fluid through said first aperture to exterior of said housing.

2. A turbine system comprising:

a source of working fluid;

a housing having a housing interior surface and a housing exterior surface, said housing being formed to contain working fluid there within;

a first aperture formed in said housing to extend between said housing interior surface and said housing exterior surface, said first aperture being sized to communicate working fluid in liquid form from said housing interior surface away from said housing exterior surface;

a rotor mounted to rotate within said housing, said rotor having a rotor interior surface and a rotor exterior surface;

a second aperture formed in said rotor to extend between said rotor interior surface and said rotor exterior surface, said second aperture being sized to communicate working fluid in liquid form from said interior surface and away from said exterior surface;

a nozzle means connected to receive said working fluid from said source of working fluid and positioned to direct said working fluid relative to said rotor interior surface to urge said rotor to rotate relative to said housing; and pump means positioned between and formed by said housing interior surface and said rotor exterior surface for pumping said working fluid through said first aperture to exterior of said housing.

3. A turbine system comprising:

a source of working fluid, said source including a vapor generator for supplying a working fluid in the form of a vapor; and a nozzle means connected to receive said working fluid in the form of a vapor from said vapor generator and to supply said vapor at at least one of a selected pressure, temperature and velocity;

a housing having a housing interior surface and a housing exterior surface, said housing being formed to contain there within working fluid from said source of working fluid;

a first aperture formed in said housing to extend between said housing interior surface and said housing exterior surface, said first aperture being sized to communicate working fluid in liquid form from said housing interior surface through said aperture to said housing exterior surface;

a rotor rotatably mounted to and within said housing, said rotor having a rotor interior surface to define the rotor interior and a rotor exterior surface, said nozzle of said vapor generator being positioned to direct said vapor relative to said interior surface of said rotor to urge said rotor to rotate relative to said housing and to extract energy from said working fluid to substantially transform said vapor to a liquid;

a second aperture formed in said rotor to extend between said rotor interior surface and said rotor exterior surface, said second aperture being sized to communicate said working fluid in liquid form from said interior surface to said exterior surface; and pump means positioned between and formed by said housing interior surface and said rotor exterior surface for pumping said working fluid in liquid form through said first aperture to exterior of said housing.

4. The turbine system of claim 3 wherein said pump means includes seal means positioned between said housing interior surface and said rotor exterior surface to effect a seal there between to inhibit the passage of working fluid there past, and wherein said pump means includes at least one chamber formed by said seal means, by the exterior surface of said rotor and by said interior surface of said housing for positively pumping said working fluid received from said second aperture through said first aperture to exterior of said housing.

5. The turbine system of claim 3 further comprising a discharge having an inlet connected to said first aperture to receive said working fluid therefrom and a outlet connected to said source of working fluid to supply said working fluid thereto.

6. The turbine system of claim 5 wherein said source of working fluid includes heat means for heating said working fluid.

7. The turbine system of claim 5 further including flow control means interconnected in said discharge to control the flow of working fluid from said heat means to said vapor generator.

8. The turbine system of claim 5 further including throttle means interconnected in said discharge to receive signals reflective of at least one of the pressure and volume of working fluid being discharged into said discharge, said throttle means having operator means for use by an operator to supply signals reflective of at least one of a desired pressure and volume of working fluid in said discharge.

9. The turbine system of claim 5 further including a cooling circuit connected to receive a portion of the working fluid in said discharge said cooling circuit being operable to cool said portion of the working fluid to a desired temperature of said working fluid at or below the temperature at which the working fluid transforms to a liquid, and said cooling circuit including a cool liquid supply connected to inject into said rotor said cooled working fluid in liquid form.

10. The turbine system of claim 3 further including deaerating means connected to communicate with the said rotor interior to remove gases from said rotor interior.

11. The turbine system of claim 4 wherein said rotor has a perimeter, wherein said rotor has a third aperture formed in said rotor to extend between said rotor interior surface and said rotor exterior surface, said third aperture being sized to communicate working fluid in liquid form from said rotor interior surface to said rotor exterior surface, wherein a fourth aperture is formed to extend between the housing interior surface and the housing exterior surface to communicate working fluid therethrough, and wherein said pump includes a first chamber formed of said seal means, the housing interior surface and said rotor exterior surface and a second chamber formed of said seal means, said housing interior surface and said rotor exterior surface, and wherein said second aperture is positioned along said perimeter to be in with said first chamber and wherein said third aperture is positioned along said perimeter to be in communication with said second chamber.

12. The turbine of claim 11 wherein said rotor rotates about a rotor axis, wherein said rotor exterior surface is formed with a first and second arcuate section each having a first effective radius extending between said rotor axis and said rotor exterior surface, and wherein said rotor exterior surface is formed with a third and fourth arcuate section having respectively a second effective radius which is larger than said first effective radius with an origin displaced from said rotor axis, said third and fourth arcuate sections being interspaced between and unitarily formed with said first and second arcuate sections.

13. The turbine system of claim 12 wherein said seal means includes a first seal positioned between said first arcuate section and said housing interior surface and a second seal positioned between said second arcuate section and said housing interior surface.

14. The turbine system of claim 13 wherein said rotor includes a fifth arcuate surface having said first effective radius and a sixth arcuate surface having said second effective radius, said fifth and sixth arcuate surfaces being adjacent a third chamber formed with said seal means, said sixth arcuate surface and said housing interior surface, and wherein said rotor includes a fifth aperture formed to communicate said working fluid from said interior surface of said rotor to said third chamber, and wherein said fifth aperture is formed in said housing spaced from said first aperture and said fourth aperture, said fifth aperture being sized to transmit working fluid from the interior housing surface to the exterior housing surface.

15. The turbine system of claim 14 wherein said seal means includes a plurality of stationary seals each spaced from the other and mounted to the housing interior surface to extend away therefrom to contact said rotor exterior surface, said seals being operable to separate each of said first chamber, said second chamber and said third chamber into an inlet portion and an outlet portion.

16. The turbine system of claim 15 wherein said rotor is cylindrical in shape and wherein said source of working fluid is positioned within said rotor.

17. The turbine system of claim 16 wherein said source of working fluid is sized and configured to supply said working fluid at a selected temperature and pressure and flow rate to create a working fluid layer along the rotor interior surface.

18. The turbine system of claim 6 further including flow control means interconnected in said discharge to control the flow of working fluid from said heat means to said vapor generator, said flow control means having throttle means interconnected in said discharge to regulate the flow of working fluid in said discharge, said throttle means having operator means for use by an operator to supply signals reflective of a desired flow of working fluid in said discharge.

19. The turbine system of claim 18 wherein said throttle means includes a regulator connected to said discharge to receive working fluid therefrom, said regulator being operable between a first position in which no working fluid passes therethrough and a second position in which working fluid passes therethrough and said regulator having operation means for operation by a user to position said regulator between said first position and said second position.

20. The turbine system of claim 19 wherein said regulator is a valve and said operation means is a handle connected to said valve for operation by a user to move said valve between said first position and said second position.

21. The turbine system of claim 18 wherein said source of working fluid includes a supply line interconnected between said heat means and said vapor generator to communicate said working fluid from said heat means to said vapor generator, and wherein said source of working fluid includes a flow control module connected in said supply line to receive working fluid from said heat means and to supply working fluid to said vapor generator, said flow control module being operable to regulate the flow rate of working fluid.

22. The turbine system of claim 21 wherein said flow control module includes a sensing line connected to said discharge to receive working fluid from said discharge line, a flow control valve connected to said sensing line to receive said working fluid therefrom and connected to said supply line to regulate the flow of working fluid therethrough, said flow control valve being operable between a closed position inhibiting the flow of said working fluid through said supply line and an open position in which said working fluid passes therethrough.

23. The turbine system of claim 22 wherein said flow control valve includes a pilot valve connected to said supply line to sense at least one of the pressure of said working fluid in said supply line and to send signals to said flow control valve reflective thereof.

24. The turbine system of claim 23 wherein said sensing line has interconnected therein damper means operable to dampen pressure variations in said sensing line.

25. The turbine system of claim 9 wherein said cooling circuit has a cooling line connected to said discharge to receive working fluid therefrom, wherein said cooling circuit includes a heat exchanger connected to said cooling line to receive said working fluid therefrom, said heat exchanger being operable to remove a heat from said working fluid in said cooling line, wherein said cooling circuit further includes an injection line connected to said housing to supply working fluid in liquid form thereto.

26. The turbine system of claim 25 further including bearings positioned to support said rotor and bearing fluid means connected to said injection line to receive working fluid in liquid form and connected to said bearings to supply said working fluid in liquid form to said bearings.

27. The turbine system of claim 6 wherein said heat means includes a casing, a plurality of gas plates and a plurality of fluid plates in alternating arrangement positioned within said casing, each of said fluid plates and said gas plates having a central aperture formed therein to define a combustion chamber, fuel source means positioned to supply fuel to said combustion chamber, air source means positioned to supply air to said combustion chamber, ignition means for igniting the fuel in the combustion chamber, exhaust means connected to said combustion chamber to exhaust combustion by products, and wherein each of said fluid plates has a channel formed thereon having an inlet connected to receive said working fluid and with an outlet in communication with said vapor generator, and wherein each of said gas plates has a plurality of heat transfer nodules positioned thereon.

28. The turbine system of claim 27 wherein said exhaust means includes an exhaust heat exchanger and wherein said air source means is connected to said exhaust heat exchanger to preheat air being supplied to said combustion chamber by said air source means.

29. The turbine system of claim 28 wherein said heat means includes a first catalytic converter positioned in said combustion chamber to define a first combustion zone.

30. The turbine system of claim 29 wherein said heat means includes a second catalytic converter positioned in said combustion chamber spaced from said first catalytic converter to define a second combustion zone between said first catalytic converter and said second catalytic converter.

31. The turbine system of claim 30 wherein said fuel source means includes a first fuel injector positioned to supply fuel into said first combustion zone.

32. The turbine system of claim 31 wherein said fuel source means includes a second fuel injector positioned to supply fuel into said first combustion zone.

33. The turbine system of claim 32 wherein said ignition means is a glow plug positioned to extend into said first combustion zone.

34. The turbine system of claim 3 wherein said working fluid is an aeromatic hydrocarbon.

35. The turbine system of claim 3 wherein said working fluid is diethel benzine.

36. A turbine system comprising:

a source of working fluid, said source including
a vapor generator for supplying a working fluid in the form of a vapor;
heat means for heating said working fluid; and
nozzle means connected to receive said working fluid in the form of a vapor and
to supply said vapor at a selected pressure and velocity;

a housing having a housing interior surface and a housing exterior surface, said housing being formed to contain there within working fluid from said source of working fluid;

a first aperture formed in said housing to extend between said housing interior surface and said housing exterior surface, said first aperture being sized to communicate working fluid in liquid form from said housing interior surface away from said housing exterior surface;

a rotor mounted to rotate within said housing, said rotor having a rotor interior surface to define the rotor interior and a rotor exterior surface, said nozzle of said vapor generator being positioned to direct said working fluid in the form of a vapor toward said interior surface of said rotor to urge said rotor to rotate relative to said housing and to extract energy from said working fluid and substantially transform said vapor to a liquid;

a second aperture formed in said rotor to extend between said rotor interior surface and said rotor exterior surface, said second aperture being sized to communicate said working fluid in liquid form from said interior surface to said exterior surface; and pump means positioned between and formed by said housing interior surface and said rotor exterior surface for pumping said working fluid in liquid form through said first aperture to exterior of said housing said pump means including seal means positioned between said housing interior surface and said rotor exterior surface to effect a seal there between to inhibit the passage of working fluid there past, and said pump means including at least one chamber formed by said seal means, by a portion of the exterior surface of said rotor and by a portion of said interior surface of said housing for positively pumping said working fluid received from said second aperture through said first aperture to exterior said housing upon rotation of said rotor;

a discharge having an inlet connected to said first aperture to receive said working fluid therefrom and a outlet connected to said source of working fluid to supply working fluid thereto;

flow control means interconnected in said discharge to control the flow of working fluid from said heat means to said vapor generator;

throttle means interconnected in said discharge to receive signals reflective of at least one of the pressure and volume of working fluid being discharged into said discharge, said throttle means having operator means for use by an operator to supply signals reflective of at least one of a desired pressure and volume of working fluid in said discharge.

37. The turbine system of claim 36 further including a cooling circuit connected to receive a portion of the working fluid in said discharge, said cooling circuit being operable to cool said portion of the working fluid to a desired temperature of said working fluid at or below the temperature at which the working fluid transforms to a vapor, and said cooling circuit including a cool liquid supply connected to inject into said rotor said cooled working fluid in liquid form.

38. The turbine system of claim 37 further including deaerating means connected to communicate with the said rotor interior to remove gases from said rotor interior.

39. A turbine system comprising:

a source of working fluid, said source including
a vapor generator for supplying a working fluid in the form of a vapor, and
nozzle means connected to receive said working fluid in the form of a vapor from said vapor generator and to supply said vapor at at least one of a selected pressure, temperature and velocity;

a housing having a housing interior surface and a housing exterior surface, said housing being formed to contain there within working fluid from said source of working fluid;

a first aperture formed in said housing to extend between said housing interior surface and said housing exterior surface, said first aperture being sized to communicate working fluid in liquid form from said housing interior surface away from said housing exterior surface;

a rotor mounted to rotate about a rotor axis within said housing, said rotor having a perimeter, a rotor interior surface and a rotor exterior surface, said nozzle of said vapor generator being positioned to direct said working fluid in the form of a vapor relative to said interior surface of said rotor to urge said rotor to rotate relative to said housing and to extract energy from said working fluid and substantially transform said vapor to a liquid, said rotor exterior surface being formed with a first and second arcuate section each having a first effective radius extending between said rotor axis and said rotor exterior surface, and said rotor exterior surface being formed with a third and fourth arcuate section each having respectively a second effective radius which is larger than said first effective radius, said third and fourth arcuate sections being interspaced between and unitarily formed with said first and second arcuate sections;

a second aperture and a third aperture each formed in said rotor to be spaced from the other and to extend between said rotor interior surface and said rotor exterior surface, said second aperture and said third aperture each being sized to communicate said working fluid in liquid form from said rotor interior surface to said rotor exterior surface; and pump means positioned between and formed by said housing interior surface and said rotor exterior surface for pumping said working fluid in liquid form through said first aperture to exterior said housing, said pump including a first chamber formed of said seal means and said third arcuate section and a second chamber formed of said seal means and said fourth arcuate section, said second aperture being positioned along said perimeter to be in communication with said first chamber and said third aperture being positioned along said perimeter to be in communication with said second chamber.

40. The turbine system of claim 39 wherein said rotor includes a fifth arcuate surface having said first effective radius and a sixth arcuate surface having said second effective radius, said fifth and sixth arcuate surface being adjacent to each other and interspaced about said perimeter, and wherein said pump means includes a third chamber formed with said seal means, said sixth arcuate surface and said housing interior surface, and wherein said rotor has a fourth aperture positioned to communicate between said rotor interior surface and said third chamber.

41. The turbine system of claim 40 wherein said rotor is cylindrical in shape and wherein said source of working fluid is positioned within said rotor.

42. The turbine system of claim 41 wherein said source of working fluid is sized and configured to supply said working fluid at a selected temperature and pressure and flow rate to create a working fluid layer along the rotor interior surface.

43. A turbine system comprising:

a source of working fluid;

a housing having a housing interior surface and a housing exterior surface, said housing being formed to contain working fluid there within;

a first aperture formed in said housing to extend between said housing interior surface and said housing exterior surface, said first aperture being sized to communicate working fluid in liquid form from said housing interior surface to said housing exterior surface;

a rotor mounted to rotate within said housing, said rotor having a rotor interior surface and a rotor exterior surface;

a second aperture formed in said rotor to extend between said rotor interior surface and said rotor exterior surface, said second aperture being sized to communicate working fluid in liquid form from said interior surface to said exterior surface;

nozzle means connected to receive said working fluid from said source of working fluid and positioned to direct said working fluid toward said rotor interior surface to urge said rotor to rotate relative to said housing; and pump means positioned between and formed by said housing interior surface and said rotor exterior surface for pumping said working fluid through said first aperture to exterior of said housing.

44. A turbine system comprising:

a source of working fluid, said source including a vapor generator for supplying a working fluid in the form of a vapor; and a nozzle means connected to receive said working fluid in the form of a vapor from said vapor generator and to supply said vapor at a selected pressure;

a housing having a housing interior surface and a housing exterior surface, said housing being formed to contain there within working fluid from said source of working fluid;

a first aperture formed in said housing to extend between said housing interior surface and said housing exterior surface, said first aperture being sized to communicate working fluid in liquid form from said housing interior surface through said aperture to said housing exterior surface;

a rotor rotatably mounted to and within said housing, said rotor having a rotor interior surface to define the rotor interior and a rotor exterior surface, said nozzle of said vapor generator being positioned to direct said vapor relative to said interior surface of said rotor to urge said rotor to rotate relative to said housing and to extract energy from said working fluid to substantially transform said vapor to a liquid;

a second aperture formed in said rotor to extend between said rotor interior surface and said rotor exterior surface, said second aperture being sized to communicate said working fluid in liquid form from said interior surface to said exterior surface; and pump means positioned between and formed by said housing interior surface and said rotor exterior surface for pumping said working fluid in liquid form through said first aperture to exterior of said housing.

45. The turbine system of claim 44 wherein said pump means includes seal means positioned between said housing interior surface and said rotor exterior surface to effect a seal there between to inhibit the passage of working fluid there past, and wherein said pump means includes at least one chamber formed by said seal means, by the exterior surface of said rotor and by said interior surface of said housing for positively pumping said working fluid received from said second aperture through said first aperture to exterior said housing.

* * * * *